US008497857B2

(12) United States Patent
Nakamura

(10) Patent No.: US 8,497,857 B2
(45) Date of Patent: Jul. 30, 2013

(54) DISPLAY DEVICE

(75) Inventor: Kazuo Nakamura, Kanagawa (JP)

(73) Assignee: Sony Corporation, Tokyo (JP)

( * ) Notice: Subject to any disclaimer, the term of this patent is extended or adjusted under 35 U.S.C. 154(b) by 372 days.

(21) Appl. No.: 12/923,058

(22) Filed: Aug. 31, 2010

(65) Prior Publication Data

US 2011/0069061 A1 Mar. 24, 2011

(30) Foreign Application Priority Data

Sep. 18, 2009 (JP) ..... 2009-217183

(51) Int. Cl.

| | |
|---|---|
| ***G06F 5/00*** | (2006.01) |
| ***G06F 3/038*** | (2006.01) |
| ***G09G 3/30*** | (2006.01) |
| ***H01L 29/10*** | (2006.01) |

(52) U.S. Cl.
USPC ..... 345/214; 345/76; 345/204; 257/59

(58) Field of Classification Search
USPC ..... 345/76, 214, 82; 257/59
See application file for complete search history.

(56) References Cited

U.S. PATENT DOCUMENTS

| | | | | |
|---|---|---|---|---|
| 7,635,863 | B2 * | 12/2009 | Yamazaki et al. | 257/59 |
| 7,696,965 | B2 * | 4/2010 | Cok | 345/82 |
| 2005/0285823 | A1 * | 12/2005 | Kimura et al. | 345/76 |
| 2006/0139254 | A1 * | 6/2006 | Hayakawa et al. | 345/76 |
| 2009/0128534 | A1 | 5/2009 | Fish et al. | |
| 2010/0073357 | A1 * | 3/2010 | Min et al. | 345/214 |

FOREIGN PATENT DOCUMENTS

| | | |
|---|---|---|
| JP | 2002-351403 | 12/2002 |
| JP | 2008-058446 | 3/2008 |
| JP | 2008-518263 | 5/2008 |

* cited by examiner

*Primary Examiner* — Kent Chang
*Assistant Examiner* — Kuo Woo
(74) *Attorney, Agent, or Firm* — Rader, Fishman & Grauer PLLC

(57) ABSTRACT

A display device includes: a display panel including a display region in which display pixels are two-dimensionally arranged, and a non-display region in which first dummy pixels and second dummy pixels are arranged; a first drive section allowing each of the first dummy pixels to emit light by applying signal voltages having different magnitudes to each of the first dummy pixels; a second drive section allowing each of the second dummy pixels to emit light by flowing constant currents having different magnitudes to each of the second dummy pixels; a current measurement section detection currents flowing through each of the first dummy pixels to output current information thereof; a light reception section detecting light emitted from each of the second dummy pixels to output luminance information thereof; and a calculation section deriving a current deterioration function using the current information, and deriving an efficiency deterioration function using the luminance information.

14 Claims, 16 Drawing Sheets

CURRENT DETERIORATION RATIO(%) OF DUMMY PIXEL 16 IN INITIAL CURRENT $S_s$

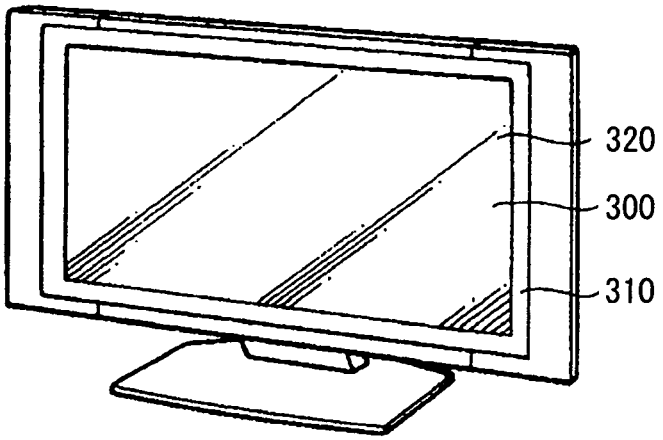
FIG. 25
FIG. 26A
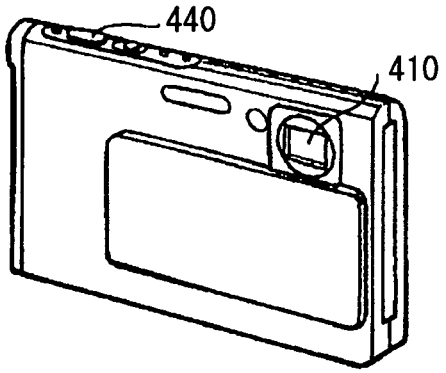
FIG. 26B
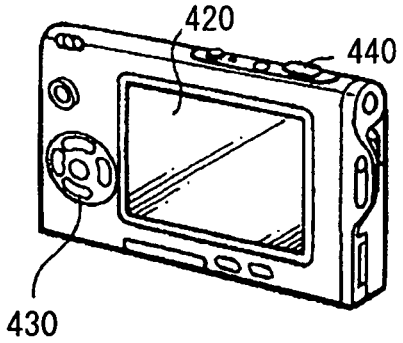

DISPLAY DEVICE

BACKGROUND OF THE PRESENT INVENTION

1. Field of the Present Invention

The present invention relates to a display device in which a light emitting element is provided in a display panel.

2. Description of the Related Art

In recent years, in the field of a display device displaying an image, a display device using, as a light emitting element of a pixel, a current drive type optical element, for example, an organic EL (electro luminescence) element, in which light emission luminance is varied according to the value of a flowing current has been developed, and progressively commercialized. Unlike a liquid crystal element or the like, the organic EL element is a self-luminous element. Thus, in a display device using the organic EL element (organic EL display device), since a light source (backlight) is not necessary, thinning and high luminance are realized in comparison with a liquid crystal display device in which the light source is necessary. In particular, in the case where the active matrix method is used as a driving method, it may be possible to light and hold each pixel, and this enables low power consumption. Therefore, the organic EL display device is expected to become the mainstream of a flat panel display in the next generation.

However, in the organic EL element, an element is deteriorated in accordance with the amount of a flowing current, and there is an issue that the luminance is reduced. Thus, in the case where the organic EL element is used as a pixel in the display device, the state of deterioration may be varied for each pixel. For example, in the case where information such as a time and a display channel is displayed with a high luminance in the same place for a long time, deterioration of only the pixels in that section is accelerated. As a result, in the case where a video having a high luminance is displayed in the section including the pixels whose deterioration is accelerated, a phenomenon called "seizure" is generated such that only the section of the pixels whose deterioration is accelerated is darkly displayed. Since the seizure is irreversible, when the seizure is once generated, it is not eliminated.

A great number of methods for preventing the seizure have been proposed so far. For example, in Japanese Unexamined Patent Publication No. 2002-351403, the method in which a dummy pixel is provided in a region other than a display region, and the deterioration degree of the dummy pixel is estimated by detecting a terminal voltage when the dummy pixel emits light, thereby correcting a video signal by utilizing that estimation is disclosed. Further, for example, in Japanese Unexamined Patent Publication No. 2008-58446 and International Publication WO 2006/046196, the methods in which an optical sensor is disposed in each display pixel, and a video signal is corrected by utilizing a light reception signal output from the optical sensor are disclosed.

SUMMARY OF THE PRESENT INVENTION

However, in the method of Japanese Unexamined Patent Publication No. 2002-351403, since the deterioration degree of the pixel is not estimated based on light emission information of a pixel in the display region, and it is difficult to accurately correct the video signal, there is an issue that the seizure is difficult to be prevented. Further, in the methods of Japanese Unexamined Patent Publication No. 2008-58446 and International Publication WO 2006/046196, since the photoelectric conversion efficiency of the optical sensor in each pixel is varied, for example, the intensity of the light reception signal may be varied in two pixels performing a display with the same luminance. As a result, there is an issue that it is difficult to accurately prevent the seizure.

In view of the foregoing, it is desirable to provide a display device capable of accurately preventing a seizure.

According to an embodiment of the present invention, there is provided a display device including: a display panel including a display region in which a plurality of display pixels are two-dimensionally arranged, and a non-display region in which a plurality of first dummy pixels and a plurality of second dummy pixels are arranged. Also, the display device includes a first drive section allowing each of the first dummy pixels to emit light by applying signal voltages having magnitudes different from each other to each of the first dummy pixels; and a second drive section allowing each of the second dummy pixels to emit light by flowing constant currents having magnitudes different from each other to each of the second dummy pixels. Further, the display device includes a current measurement section outputting current information of each of the first dummy pixels by detecting currents flowing through each of the first dummy pixels; a light reception section outputting luminance information of each of the second dummy pixels by detecting light emitted from each of the second dummy pixels; and a calculation section deriving a current deterioration function by using the current information, and deriving an efficiency deterioration function by using the luminance information.

In the display device according to the embodiment of the present invention, the signal voltages having the magnitudes different from each other are applied to each of the first dummy pixels provided in the non-display region of the display panel, each of the first dummy pixels emits the light with the luminance in accordance with the magnitude of the signal voltage, the currents flowing through each of the first dummy pixels are detected by the current measurement section, and the current information of each of the first dummy pixels is output from the current measurement section. Further, constant currents having the magnitudes different from each other are flown to each of the second dummy pixels provided in the non-display region of the display panel, each of the second dummy pixels emits light with luminance in accordance with the magnitude of the constant currents, the light emitted from each of the second dummy pixels is detected by the light reception section, and the luminance information of each of the second dummy pixels is output from the light reception section. Thereafter, the current deterioration function is derived by using the current information, and the efficiency deterioration function is derived by using the luminance information. Thereby, for example, from the current deterioration function, and a history of the video signal of each of the display pixels, the current deterioration ratio of each of the display pixels may be predicted. Further, from the efficiency deterioration function, and the history of the video signal of each of the display pixels, the efficiency deterioration ratio of each of the display pixels may be predicted.

Here, in the display device according to the embodiment of the present invention, a cycle in which the current deterioration function is derived is preferably set to be shorter than a cycle in which the efficiency deterioration function is derived. In this case, it may be possible to correct the efficiency deterioration in the state where the current is corrected.

Other and further objects, features and advantages of the present invention will appear more fully from the following description.

BRIEF DESCRIPTION OF THE DRAWINGS

FIG. 25 is a perspective view illustrating an appearance of a first application example of the display device of the foregoing embodiment.

FIG. 26A is a perspective view illustrating an appearance of a second application example as viewed from the front side, and FIG. 26B is a perspective view illustrating an appearance as viewed from the rear side.

DETAILED DESCRIPTION OF THE PREFERRED EMBODIMENT

Hereinafter, an embodiment of the present invention will be described in detail with reference to the drawings. The description will be made in the following order.

1. Embodiment (FIGS. 1 to 24)
2. Modifications (no illustrations)
   - Example where each dummy pixel 16 in which an initial current $S_i$ is low is composed of a plurality of dummy pixels
   - Example where each dummy pixel 18 in which an initial luminance $Y_i$ is low is composed of a plurality of dummy pixels
   - Example where another dummy pixel 16 is newly set as a reference pixel, in the case where a failure occurs in a reference pixel
   - Example where another dummy pixel ~is newly set as the reference pixel, in the case where a failure occurs in the reference pixel
   - Example where a sampling period $\Delta T_1$ is set to be variable
   - Example where a sampling period $\Delta T_2$ is set to be variable
   - Example where a power coefficient n ($S_i$, $S_s$) is derived only with four arithmetic operations
   - Example where a power coefficient n ($Y_i$, $Y_s$) is derived only with the four arithmetic operations
3. Application examples (FIGS. 25 to 29)

1. Embodiment (Schematic Structure of Display Device 1)

Figure 1:
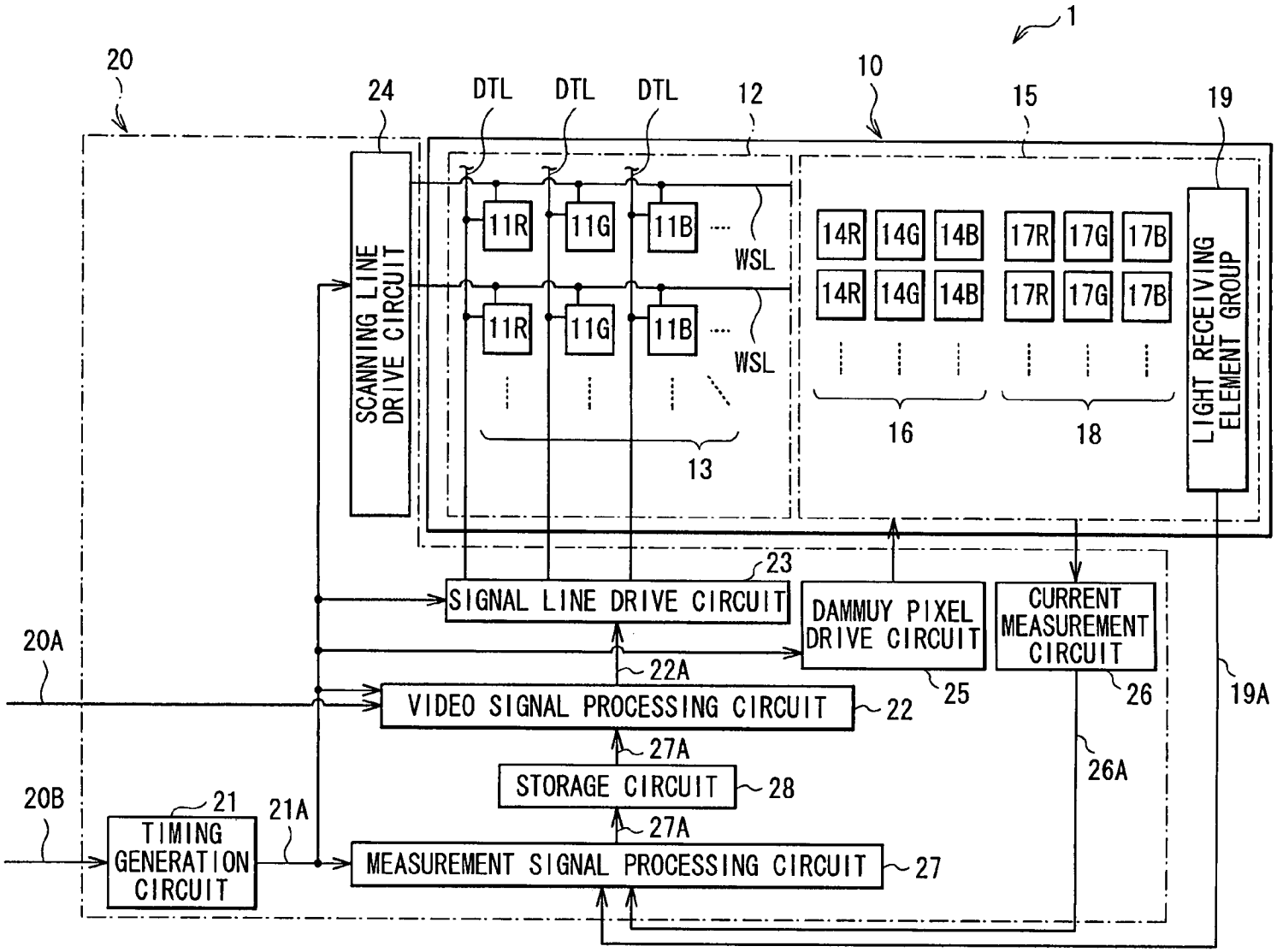
FIG. 1 is a schematic view illustrating an example of the structure of a display device according to an embodiment of the present invention.

FIG. 1 illustrates the schematic structure of a display device 1 according to an embodiment of the present invention. The display device 1 includes a display panel 10, and a drive circuit 20 driving the display panel 10.

The display panel 10 includes a display region 12 in which a plurality of organic EL elements 11R, 11G, and 11B are two-dimensionally arranged. In this embodiment, the three organic EL elements 11R, 11G, and 11B adjacent to each other constitute one pixel (display pixel 13). Hereinafter, "organic EL element 11" is appropriately used as a general term for the organic EL elements 11R, 11G, and 11B. The display panel 10 also includes a non-display region 15 in which a plurality of organic EL elements 14R, 14G, and 14B are two-dimensionally arranged. In this embodiment, the three organic EL elements 14R, 14G, and 14B adjacent to each other constitute one pixel (dummy pixel 16). Hereinafter "organic EL element 14" is appropriately used as a general term for the organic EL elements 14R, 14G, and 14B.

In the non-display region 15, further, a plurality of organic EL elements 17R, 17G, and 17B are two-dimensionally arranged. In this embodiment, the three organic EL elements 17R, 17G, and 17B adjacent to each other constitute one pixel (dummy pixel 18). Hereinafter, "organic EL element 17" is appropriately used as a general term for the organic EL elements 17R, 17G, and 17B. In the non-display region 15, a light receiving element group 19 (light reception section) receiving light which is emitted from the organic EL elements 17R, 17G, and 17B is provided. Although not illustrated in the figure, the light receiving element group 19 is, for example, composed of a plurality of light receiving elements. The plurality of light receiving elements are, for example, two-dimensionally arranged, while being paired with the individual organic EL elements 17. Each light emitting element detects light (emitted light) emitted from each dummy pixel 18 (each organic EL element 17), and outputs a light reception signal 19A (luminance information) of each dummy pixel 18. Each light receiving element is, for example, a photodiode.

The drive circuit 20 includes a timing generation circuit 21, a video signal processing circuit 22, a signal line drive circuit 23, a scanning line drive circuit 24, a dummy pixel drive circuit 25, a current measurement circuit 26, a measurement signal processing circuit 27, and a storage circuit 28.

(Pixel Circuit 31)

Figure 2:
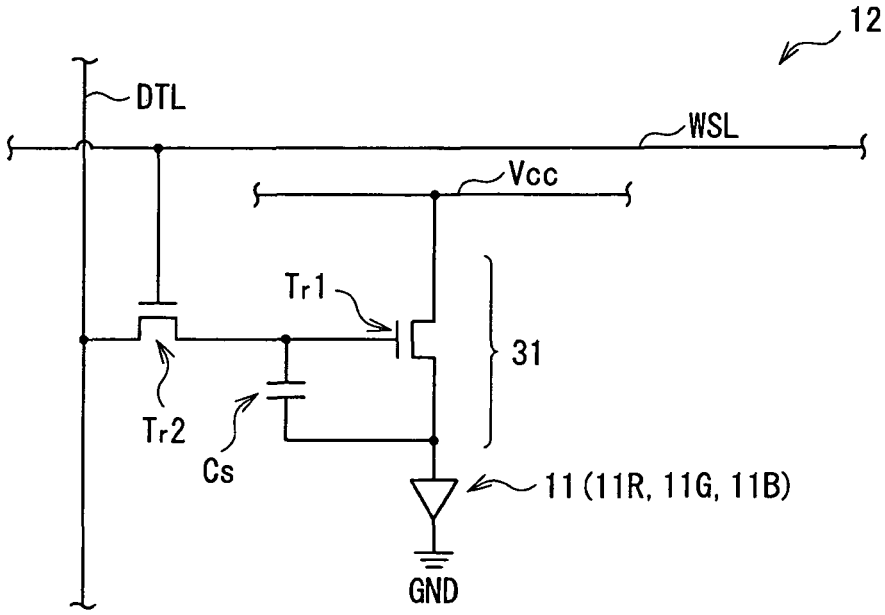
FIG. 2 is a schematic view illustrating an example of the structure of a pixel circuit of a display region.

FIG. 2 illustrates an example of a circuit structure in the display region 12. In the display region 12, a plurality of pixel circuits 31 are two-dimensionally arranged, while being paired with the individual organic EL elements 11. Each pixel circuit 31 is, for example, composed of a drive transistor $Tr_1$, a write transistor $Tr_2$, and a retention capacity $C_s$, and has the circuit structure of 2Tr1C. The drive transistor $Tr_1$ and the write transistor $Tr_2$ are, for example, formed of an n-channel MOS thin film transistor (TFT). The drive transistor $Tr_1$ or the write transistor $Tr_2$ may be a p-channel MOS TFT.

In the display region 12, a plurality of signal lines DTL are arranged in the column direction, and a plurality of scanning lines WSL and a plurality of power source lines Vcc are arranged in the row direction, respectively. In the vicinity of each intersection of each signal line DTL and each scanning line WSL, one of the organic EL elements 11R, 11G, and 11B (sub-pixel) is provided. Each signal line DTL is connected to an output terminal (not illustrated in the figure) of the signal line drive circuit 23, and a drain electrode (not illustrated in the figure) of the write transistor $Tr_2$. Each scanning line WSL is connected to an output terminal (not illustrated in the figure) of the scanning line drive circuit 24, and a gate electrode (not illustrated in the figure) of the write transistor $Tr_2$. Each power source line Vcc is connected to an output terminal (not illustrated in the figure) of a power source, and a drain electrode (not illustrated in the figure) of the drive transistor $Tr_1$. A source electrode (not illustrated in the figure) of the write transistor $Tr_2$ is connected to a gate electrode (not illustrated in the figure) of the drive transistor $Tr_1$, and one end of the retention capacity C. A source electrode (not illustrated in the figure) of the drive transistor $Tr_1$, and the other end of the retention capacity $C_s$ are connected to an anode electrode (not illustrate in the figure) of the organic EL element 11. A cathode electrode (not illustrated in the figure) of the organic EL element 11 is, for example, connected to a ground line GND.

Figure 3:
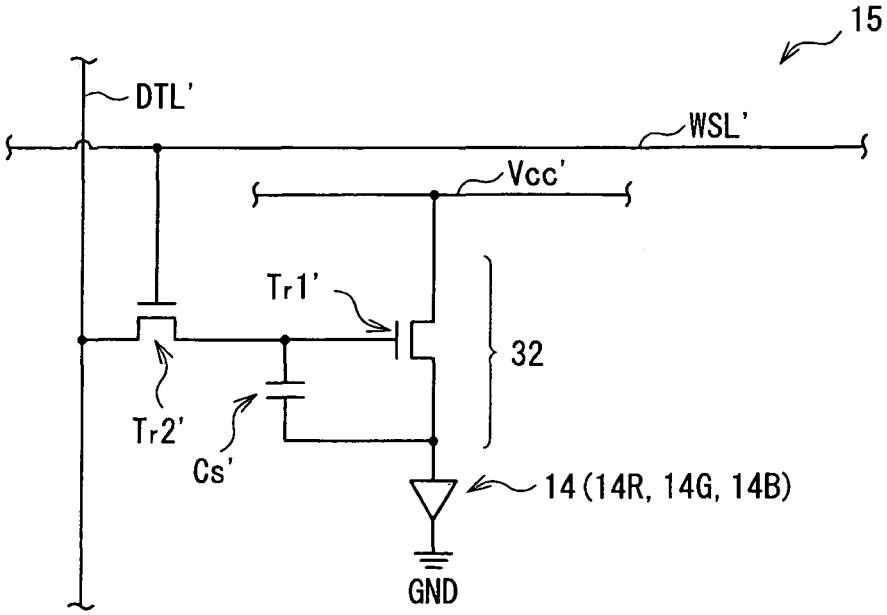
FIG. 3 is a schematic view illustrating an example of the structure of a pixel circuit of a non-display region.

FIG. 3 illustrates an example of the circuit structure in the non-display region 15. In the non-display region 15, a plurality of pixel circuits 32 having the same structure as the pixel circuits 31 are two-dimensionally arranged, while being paired with the individual organic EL elements 14. Each pixel circuit 32 is, for example, composed of a drive transistor $Tr_1'$, a write transistor $Tr_2'$, and a retention capacity $C_s'$, and has the circuit structure of 2Tr1C. The drive transistor $Tr_1'$ and the write transistor $Tr_2'$ are, for example, formed of an n-channel MOS TFT. The drive transistor $Tr_1'$ or the write transistor $Tr_2'$ may be a p-channel MOS TFT.

Also in the non-display region 15, a plurality of signal lines DTL' are arranged in the column direction, and a plurality of scanning lines WSL' and a plurality of power source lines Vcc' are arranged in the row direction, respectively. In the vicinity of each intersection of each signal line DTL' and each scanning line WSL', one of the organic EL elements 14R, 14G, and 14B (sub-pixel) is provided. Each signal line DTL' is connected to an output terminal (not illustrated in the figure) of a dummy pixel drive circuit 25, and a drain electrode (not illustrated in the figure) of the write transistor $Tr_2'$. Each scanning line WSL' is connected to an output terminal (not illustrated in the figure) of the dummy pixel drive circuit 25, and a gate electrode (not illustrated in the figure) of the write transistor $Tr_2'$. Each power source line Vcc' is connected to an output terminal (not illustrated in the figure) of the power source, and a drain electrode (not illustrated in the figure) of the drive transistor $Tr_1'$. A source electrode (not illustrated in the figure) of the write transistor $Tr_2'$ is connected to a gate electrode (not illustrated in the figure) of the drive transistor $Tr_1'$, and one end of the retention capacity $C_s'$. A source electrode (not illustrated in the figure) of the drive transistor $Tr_1'$, and the other end of the retention capacity $C_s'$ are connected to an anode electrode (not illustrate in the figure) of the organic EL element 14. A cathode electrode (not illustrated in the figure) of the organic EL element 14 is, for example, connected to the ground line GND.

(Top Face Structure of Display Panel 10)

Figure 4:
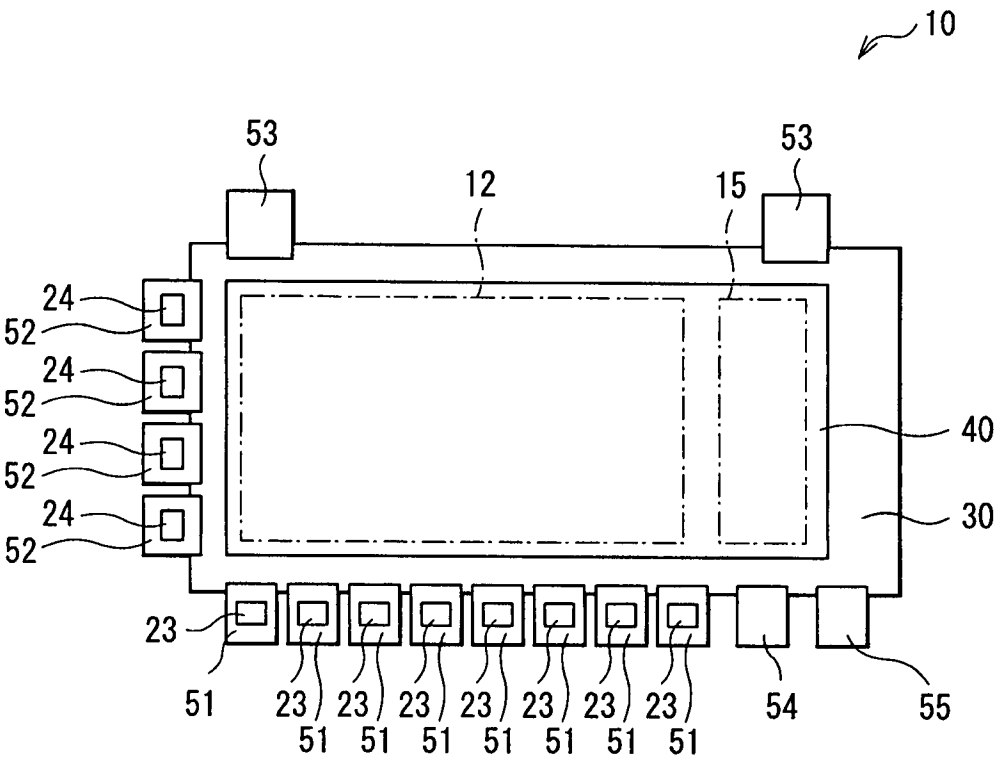
FIG. 4 is a top face view illustrating an example of the structure of a display panel in FIG. 1.

FIG. 4 illustrates an example of the top face structure of the display panel 10. The display panel 10 has, for example, the structure in which a drive panel 30 and a sealing panel 40 are bonded through a sealing layer (not illustrated in the figure).

Although not illustrated in FIG. 4, the drive panel 30 includes the plurality of organic EL elements 11 two-dimensionally arranged, and the plurality of pixel circuits 31 arranged adjacent to each organic EL element 11 in the display region 12. Further, although not illustrated in FIG. 4, the drive panel 30 includes a plurality of organic EL elements 14 and 17 two-dimensionally arranged, and a plurality of light receiving elements arranged adjacent to each organic EL element 17 in the non-display region 15.

On one side (long side) of the drive panel 30, for example, as illustrated in FIG. 4, a plurality of video signal suppliers TAB 51, a control signal supplier TCP 54, and a measurement signal output TCP 55 are installed. On the other side (short side) of the drive panel 30, for example, scanning signal suppliers TAB 52 are installed. Further, on one side (long side) of the drive panel 30 but different from the side of the video signal supplier TAB 51, for example, power source suppliers TCP 53 are installed. The video signal supplier TAB 51 is formed by aerially wiring an IC in which the signal line drive circuit 23 is integrated, to an aperture of a film-shaped wiring substrate. The scanning signal supplier TAB 52 is formed by aerially wiring an IC in which the scanning line drive circuit 24 is integrated, to an aperture of a film-shaped wiring substrate. The power source supplier TCP 53 is formed by forming a plurality of wirings which electrically connect an external power source, and the power source lines Vcc and Vcc' each other on a film. The control signal supplier TCP 54 is formed by forming a plurality of wirings which electrically connect the external dummy pixel drive circuit 25, and the dummy pixels 16 and 18 and the light receiving element group 19 each other on a film. The measurement signal output TCP 55 is formed by forming a plurality of wirings which electrically connect the external measurement signal processing circuit 27 and the light receiving element group 19 each other on a film. In addition, the signal line drive circuit 23 and the scanning line drive circuit 24 may not be formed in the TABs, and may be formed, for example, on the drive panel 30.

The sealing panel 40 includes, for example, a sealing substrate (not illustrated in the figure) which seals the organic EL elements 11, 14, and 17, and a color filter (not illustrated in the figure). The color filter is, for example, provided in a region where light of the organic EL element 11 transmits on the surface of the sealing substrate. The color filter includes, for example, a filter for red, a filter for green, and a filter for blue (not illustrated in the figure), corresponding to each of the organic EL elements 11R, 11G, and 11B. Further, the sealing panel 40 includes, for example, a light reflecting section (not illustrated in the figure). The light reflecting section is intended to reflect light emitted from the organic EL element 17, thereby allowing the light to enter the light receiving element group 19. For example, the light reflecting section is provided in a region where the light of the organic EL element 17 transmits on the surface of the sealing substrate.

(Drive Circuit 20)

Next, each circuit in the drive circuit 20 will be described with reference to FIG. 1. The timing generation circuit 21 controls the video signal processing circuit 22, the signal line drive circuit 23, the scanning line drive circuit 24, the dummy pixel drive circuit 25, the current measurement circuit 26, and the measurement signal processing circuit 27, thereby allowing them to operate in conjugation with each other.

The timing generation circuit 21 outputs, for example, a control signal 21A to each of the above-described circuits in response to (in synchronization with) a synchronization signal 20B input from outside. The timing generation circuit 21 is formed, for example, together with the video signal processing circuit 22, the dummy pixel drive circuit 25, the current measurement circuit 26, the measurement signal processing circuit 27, the storage circuit 28, and the like, for example, on a control circuit substrate (not illustrated in the figure) provided separately from the display panel 10.

The video signal processing circuit 22 corrects, for example, a digital video signal 20A input from outside in response to (in synchronization with) an input of the control signal 21A, and converts the corrected video signal into an analogue signal to output the analogue signal to the signal line drive circuit 23. In this embodiment, the video signal processing circuit 22 corrects the video signal 20A by using a correction information 27A (will be described later) read from the storage circuit 28. For example, the video signal processing circuit 22 reads, as the correction information 27A, a correction amount (a current correction amount $R_I$, and an efficiency correction amount $R_y$) (will be described later) of each display pixel 13 of one line from the storage circuit 28 for each horizontal period, and corrects the video signal 20A by using the read correction amount (the current correction amount $R_I$, and the efficiency correction amount $R_y$) to output a corrected video signal 22A to the signal line drive circuit 23.

The signal line drive circuit 23 outputs the analogue video signal 22A input from the video signal processing circuit 22 to each signal line DTL in response to (in synchronization with) the input of the control signal 21A. As illustrated in FIG. 4, for example, the signal line drive circuit 23 is provided in the video signal supplier TAB 51 installed on one side (long side) of the drive panel 30. The scanning line drive circuit 24 sequentially selects one scanning line WSL from the plurality of scanning lines WSL in response to (in synchronization with) the input of the control signal 21A. As illustrated in FIG. 4, for example, the scanning line drive circuit 24 is provided in the scanning signal supplier TAB 52 installed on the other side (short side) of the drive panel 30.

The measurement signal processing circuit 27 derives the correction information 27A based on the light reception signal 19A input from the light receiving element group 19, and outputs the derived correction information 27A to the storage circuit 28 in response to (in synchronization with) the input of the control signal 21A.

In addition, the deriving method of the correction information 27A will be described later. The storage circuit 28 stores the correction information 27A input from the measurement signal processing circuit 27, so that the video signal processing circuit 22 may read the correction information 27A stored in the storage circuit 28.

(Current Correction)

The dummy pixel drive circuit 25 applies signal voltages $V_{sigi}$ (constant value) whose magnitudes are different from each other to the signal lines DTL' connected to each dummy pixel 16 in response to (in synchronization with) the input of the control signal 21A, and thereby allowing each dummy pixel 16 to emit light with gray scales different from each other. For example, in the case where the number of the dummy pixels 16 is n, the dummy pixel drive circuit 25 allows a constant current to flow through the first dummy pixel 16 so that an initial current is $S_I$, allows a constant current to flow through the second dummy pixel 16 so that an initial current is $S_2$ ($>S_1$), allows a constant current to flow through the $i^{th}$ dummy pixel 16 so that an initial current is $S_i$ ($>S_{i-1}$), and allows a constant current to flow through the $n^{th}$ dummy pixel 16 so that an initial current is $S_n$ ($>S_{n-1}$). The dummy pixel drive circuit 25 measures, for example, the time during each dummy pixel 16 emitting light.

Figure 5:
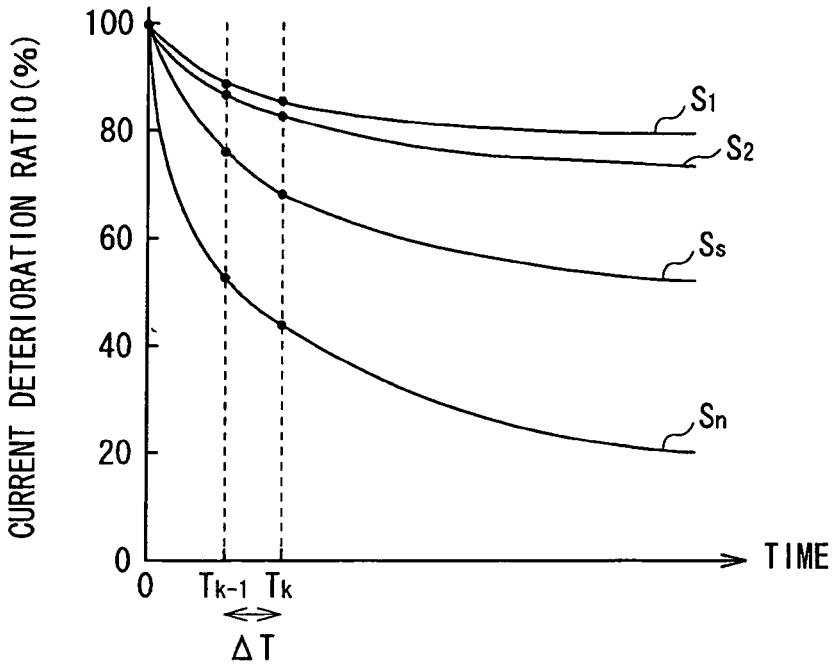
FIG. 5 is a characteristic view illustrating an example of a temporal change of a current deterioration ratio for each initial current.

In addition, even in the case where the signal voltages $V_{sigi}$ having the constant value are continued to be applied to the signal lines DTL' which are connected to each dummy pixel 16, the luminance of each dummy pixel 16 is gradually reduced with the passage of time, for example, as illustrated in FIG. 5. This is because a semiconductor element such as the drive transistor $Tr_1$' included in the pixel circuit 32 which is connected to each dummy pixel 16 has a property to deteriorate in accordance with the current application time (current application accumulation time), and the current becomes difficult to flow in accordance with the progress of the deterioration. In addition, "$S_s$" in FIG. 5 represents an initial current flowing through the organic EL element 14 in the pixel set as a reference pixel (will be described later) in each dummy pixel 16.

Figure 6:
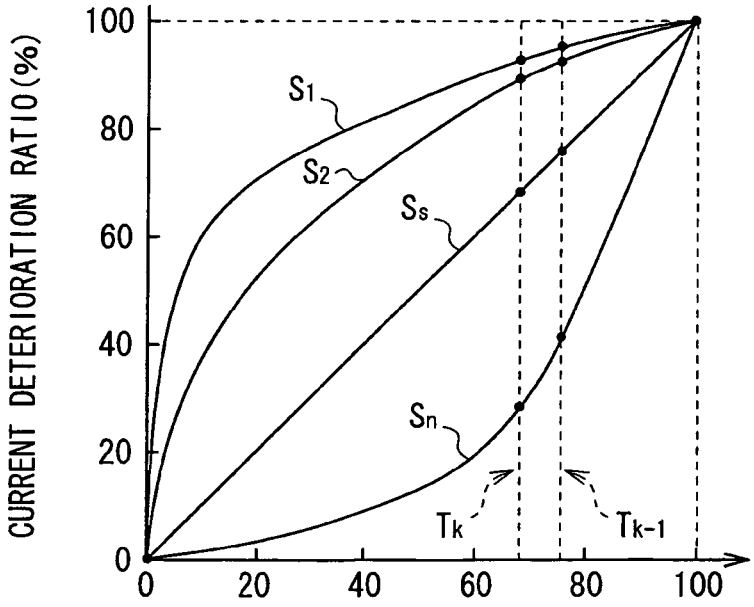
FIG. 6 is a relationship view illustrating an example of the relationship between the current deterioration ratio and the current deterioration ratio of a dummy pixel of an initial current $S_s$.

The change of the deterioration ratio (current deterioration ratio) of the current flowing through the organic EL element 14 in each dummy pixel 16 is not uniform. For example, as illustrated in FIG. 6, when the current deterioration ratio of the pixel (dummy pixel 16) set as the reference pixel is indicated on the abscissa axis, it can be seen that the change of the current deterioration ratio of the dummy pixel 16 having the initial current smaller than the initial current $S_S$ of the reference pixel is more gradual than the change of the current deterioration of the reference pixel at the beginning. On the other hand, it can be seen that the change of the current deterioration ratio of the dummy pixel 16 having the initial current larger than the initial current $S_S$ of the reference pixel is steeper than the change of the current deterioration of the reference pixel at the beginning. The change of the current deterioration ratio of each dummy pixel 16 exemplified in FIG. 6 is represented by the following equation.

$$D_{si}=D_{ss}^{n(Si,Ss)} \qquad \text{Equation 1}$$

In the Equation 1, $D_{si}$ represents the current deterioration ratio of the $i^{th}$ dummy pixel 16. $D_{ss}$ represents the current deterioration ratio of the reference pixel. n ($S_i$, $S_s$) represents a power coefficient of the current of the $i^{th}$ dummy pixel 16 to the current of the reference pixel. The power coefficient n ($S_i$, $S_s$) is, for example, derived by dividing (Log ($S_i(T_k)$)−Log ($S_i(T_{k-1})$) by (Log ($S_s(T_k)$)−Log ($S_s(T_{k-1})$), for example, as indicated in the following equation.

$$n(S_i, S_s) = \frac{\mathrm{Log}(S_i(T_k)) - \mathrm{Log}(S_i(T_{k-1}))}{\mathrm{Log}(S_s(T_k)) - \mathrm{Log}(S_s(T_{k-1}))} \quad \text{Equation 2}$$

In the Equation 2, Log ($S_s(T_k)$) represents a logarithm of $S_s$ ($T_k$), Log ($S_s(T_{k-1})$) represents a logarithm of $S_s$ ($T_{k-1}$), Log ($S_i(T_k)$) represents a logarithm of $S_i(T_k)$, and Log ($S_i(T_{k-1})$) represents a logarithm of $S_i(T_{k-1})$.

In the Equation 2, $S_s$ ($T_k$) represents a current signal 26A (current information) of the reference pixel at the time $T_k$, and corresponds to the latest current information in the current information of the reference pixel. $S_s(T_k)$ represents the current signal 26A (current information) of the reference pixel at the time $T_{k-1}$(<time $T_k$), and corresponds to the non-latest current information in the current information of the reference pixel. $S_i(T_k)$ represents the current signal 26A (current information) of the $i^{th}$ dummy pixel 16 at the time $T_k$, and corresponds to the latest current information in the current information of the dummy pixel 16 (non-reference pixel). $S_i$ ($T_{k-1}$) represents the current signal 26A (current information) of the $i^{th}$ dummy pixel 16 at the time $T_{k-1}$, and corresponds to the non-latest current information in the current information of the $i^{th}$ dummy pixel 16 (non-reference pixel). The relationship between the time $T_{k-1}$ and the time $T_k$ is, for example, represented by the following equation.

$$T_k = T_{k-1} + \Delta T_1 \quad \text{Equation 3}$$

In the Equation 3, $\Delta T_1$ represents a sampling period. Here, the sampling period $\Delta T_1$ indicates, for example, a cycle in which the measurement signal processing circuit 27 derives the value of the denominator and the value of the numerator on the right side of the Equation 2. The sampling period $\Delta T_1$ is preferably set to be shorter than a sampling period $\Delta T_2$ which will be described later. The measurement signal processing circuit 27 sets the sampling period $\Delta T_1$ to be constant at any time.

Figure 7:
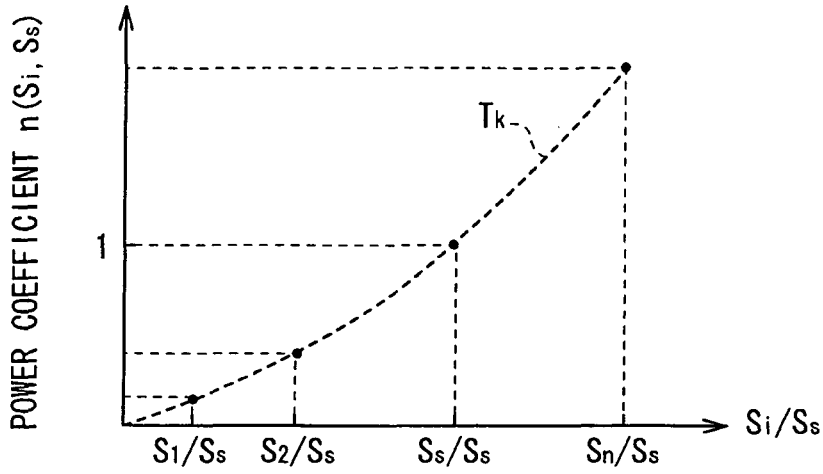
FIG. 7 is a relationship view illustrating an example of the relationship between a power coefficient n ($S_i$, $S_s$), and an initial current ratio $S_i/S_s$.
Figure 8:
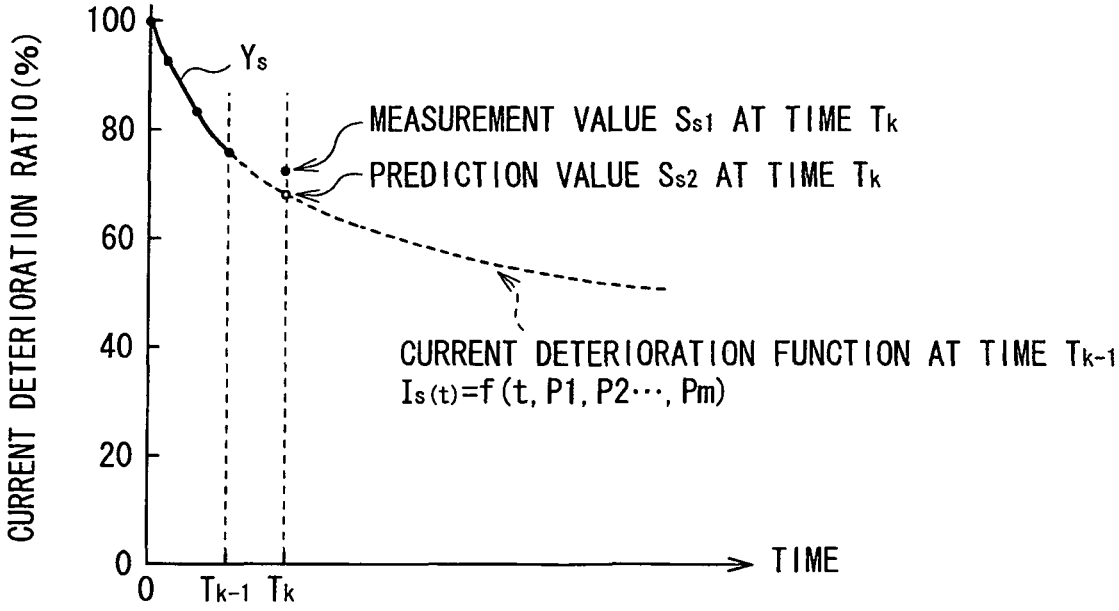
FIG. 8 is a relationship view illustrating an example of the relationship between a prediction value $S_{s2}$ of the current deterioration ratio at a time $T_k$, and a measurement value $S_{s1}$ of the current deterioration ratio at the time $T_k$.

For example, as illustrated in FIG. 7, when the abscissa axis indicates the ratio ($S_i$/ $S_s$) of the initial current $S_i$ of each dummy pixel 16 to the initial current $S_s$ of the reference pixel, the power coefficient n ($S_i$, $S_s$) derived in the manner described above draws a rightward rising curve which increases with an increase of the initial current $S_i$, at the time $T_k$. In addition, as can be obviously seen from the Equation 2, the power coefficient n ($S_i$, $S_s$) is 1 in $S_s/S_s$.

Next, with reference to FIGS. 8 to 14, the deriving method of the current correction amount $R_1$ used for correcting the video signal 20A will be described.

(Initial Setting)

First, the initial setting will be described. The measurement signal processing circuit 27 sets one pixel in the plurality of dummy pixels 16 as the reference pixel. In this embodiment, the reference pixel is not changed to another dummy pixel 16 (non-reference pixel), and the same dummy pixel 16 is always set as the reference pixel.

Next, from the current measurement circuit 26, the measurement signal processing circuit 27 obtains the current signal 26A at the times $T_1$ and $T_2$. Specifically, from the current measurement circuit 26, the measurement signal processing circuit 27 obtains the current signal 26A of the reference pixel as being one pixel in the plurality of dummy pixels 16, at the times $T_1$ and $T_2$. Further, from the current measurement circuit 26, the measurement signal processing circuit 27 obtains the current signal 26A of the plurality of non-reference pixels as being all the pixels except the reference pixel in the plurality of dummy pixels 16, at the the times $T_1$ and $T_2$. Next, the measurement signal processing circuit 27 derives, from the current information of the reference pixel, the current deterioration information (Log ($S_s(T_2)$)−Log ($S_s(T_1)$)) of the reference pixel, and derives, from the current information of each non-reference pixel, the current deterioration information (Log ($S_i(T_2)$)−Log ($S_i(T_1)$)) of each non-reference pixel.

Next, from the current deterioration information of the reference pixel, and the current deterioration information of each non-reference pixel, the measurement signal processing circuit 27 derives the power coefficient n ($S_i$, $S_s$) of the current information of each non-reference pixel to the current information of the reference pixel at the time $T_2$. Next, from the current information of the reference pixel, the measurement signal processing circuit 27 derives a current deterioration function $I_s$ (t) representing the temporal change of the current of the reference pixel at the time $T_2$. Further, from the current deterioration function $I_s$(t) and the power coefficient n ($S_i$, $S_s$), the measurement signal processing circuit 27 derives a current deterioration function $I_i$ (t) representing the temporal change of the current of each non-reference pixel at the time $T_2$. In this manner, the measurement signal processing circuit 27 derives the current deterioration functions $I_s$ (t), and $I_i$ (t) at the time $T_2$ by using the initial current information.

(Data Update)

Next, the data update will be described. From the current measurement circuit 26, the measurement signal processing circuit 27 obtains the current signal 26A of the reference pixel, and the current signal 26A of the plurality of non-reference pixels at the times $T_{k-1}$ and $T_k$. The value (measurement value) of the current signal 26A of the reference pixel at this time is regarded as $S_{s1}$ (refer to FIG. 8). Next, from the current deterioration function $I_s$ (t) at the time $T_{k-1}$, the measurement signal processing circuit 27 predicts the current information of the reference pixel at the time $T_k$. The prediction value at this time is regarded as $S_{s2}$ (refer to FIG. 8). Next, from the comparison between the measurement value $S_{s1}$ and the prediction value $S_{s2}$, the measurement signal processing circuit 27 determines whether or not the measurement value $S_{s1}$ and the prediction value $S_{s2}$ are coincident with each other. As a result, for example, in the case where the measurement value $S_{s1}$ and the prediction value $S_{s2}$ are coincident with each other, the measurement signal processing circuit 27 regards the current deterioration function $I_s$ (t) at the time $T_{k-1}$ as the current deterioration function $I_s$ (t) at the time $T_k$. On the other hand, for example, in the case where the measurement signal processing circuit 27 determines that the measurement value $S_{s1}$ is different from the prediction value $S_{s2}$ based on the comparison between the measurement value $S_{s1}$ and the prediction value $S_{s2}$, the measurement signal processing circuit 27 derives the current deterioration function $I_s$ (t) at the time $T_k$, from the current information of the reference pixel.

Next, from the current information of the reference pixel, the measurement signal processing circuit 27 derives the current deterioration information (Log (Ss($T_k$))−Log ($S_s(T_{k-1})$)) of the reference pixel. Further, from the current information of the plurality of non-reference pixels, the measurement signal processing circuit 27 derives the current deterioration information (Log ($S_i(T_k)$)−Log ($S_i(T_{k-1})$)) of each non-reference pixel. Next, from the current deterioration information of the reference pixel, and the current deterioration information of each non-reference pixel, the measurement signal processing circuit 27 derives the power coefficient n ($S_i$, $S_s$) at the time $T_k$.

Figure 9:
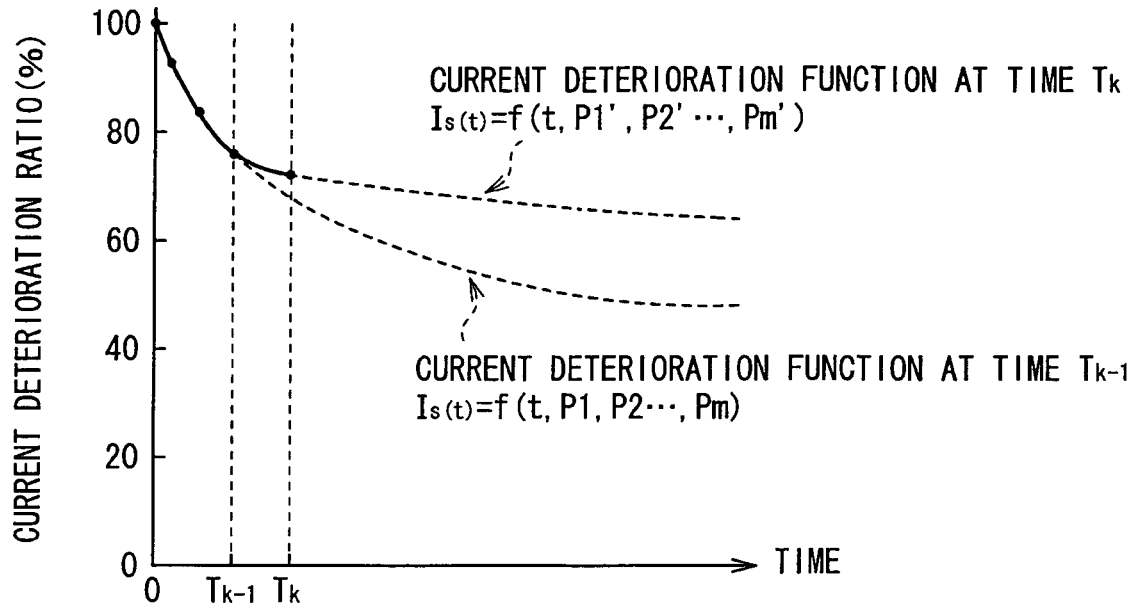
FIG. 9 is a relationship view illustrating an example of the relationship between a current deterioration function $I_s$ (t) at a time $T_{k-1}$, and the current deterioration function $I_s$ (t) at the time $T_k$.
Figure 10:
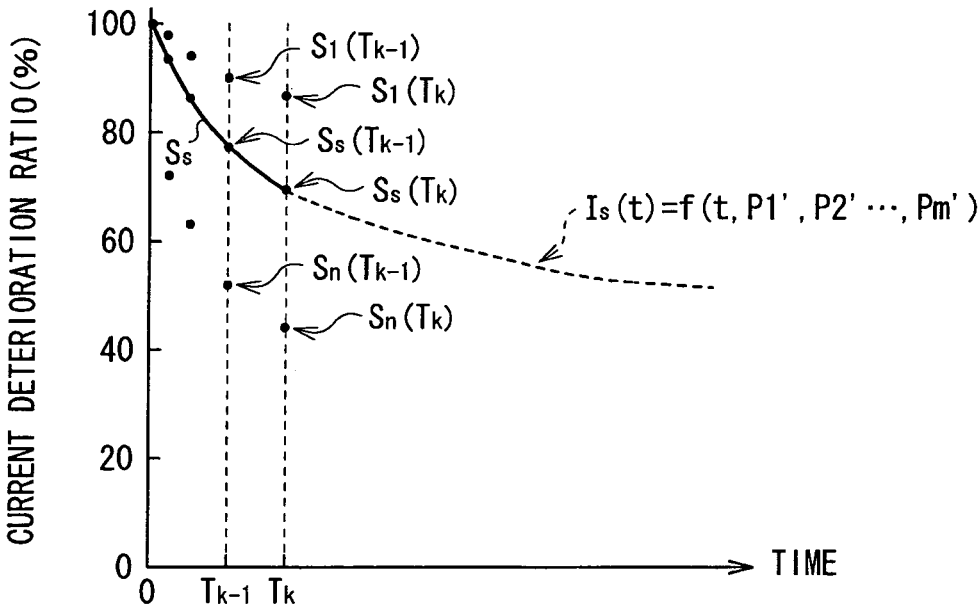
FIG. 10 is a conceptual view for explaining an example of a calculating method of the power coefficient.
Figure 11:
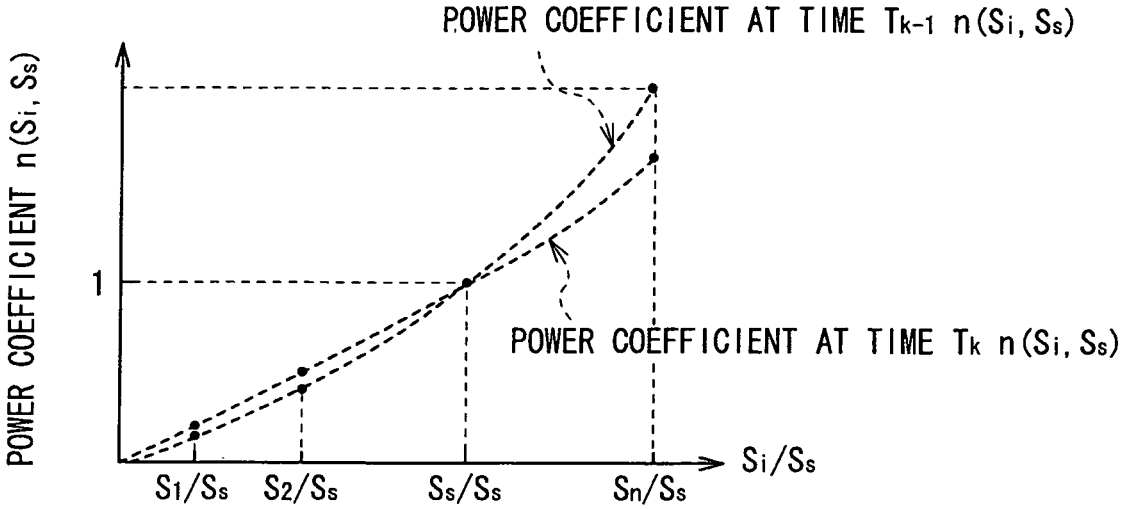
FIG. 11 is a relationship view illustrating an example of the relationship between the power coefficient n ($S_i$, $S_s$) at the time $T_{k-1}$, and the power coefficient n ($S_i$, $S_s$) at the time $T_k$.

Next, the measurement signal processing circuit 27 updates parameters (for example, p1, p2, . . . , pm) of the current deterioration function $I_s$ (t) at the time $T_{k-1}$ to parameters (for example, p1', p2', . . . , pm') of the current deterioration function $I_s$ (t) at the time $T_k$ (refer to FIG. 9). In other words, the measurement signal processing circuit 27 updates the parameters of the current deterioration function $I_s$ (t) in accordance with the latest current information ($S_s(T_k)$) in the current information of the reference pixel, and the non-latest current information ($S_s(T_{k-1})$) in the current information of the reference pixel. The measurement signal processing circuit 27 stores, for example, the parameters of the newly-obtained current deterioration function $I_s$ (t) in the storage circuit 28.

Figure 12:
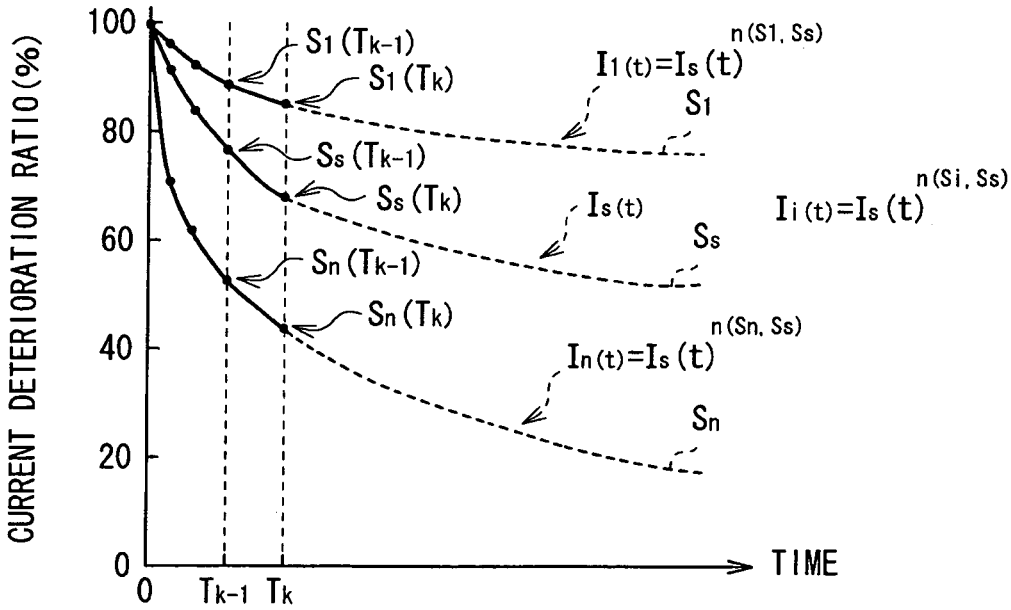
FIG. 12 is a conceptual view for explaining an example of a calculating method of a current deterioration function $I_i$ (t).

Next, from the current deterioration function $I_s$ (t) at the time $T_k$ (refer to FIG. 10), and the power coefficient n ($S_i$, $S_s$) (refer to FIG. 11), the measurement signal processing circuit 27 derives the current deterioration function $I_i$ (t) at the time $T_k$ (refer to FIG. 12). Specifically, the measurement signal processing circuit 27 derives the current deterioration function $I_i$ (t) at the time $T_k$ by using the following equation.

$$I_i(t)=I_s(t)^{n(Si,\,Ss)} \qquad \text{Equation 4}$$

Next, the measurement signal processing circuit 27 updates the parameter of the current deterioration function $I_i$ (t) of each non-reference pixel at the time $T_{k-1}$ to the parameters of the current deterioration function $I_i$ (t) of each non-reference pixel at the time $T_k$. The measurement signal processing circuit 27 stores, for example, the parameters of the newly-obtained current deterioration function $I_i$ (t) in the storage circuit 28.

(Prediction of Current Deterioration Ratio)

Next, the measurement signal processing circuit 27 predicts the current deterioration ratio of each display pixel 13 during the time until the next sampling period comes. Specifically, from the current deterioration function $I_s$ (t), the current deterioration function $I_i$ (t), and a history of the video signal 20A of each display pixel 13, the measurement signal processing circuit 27 derives a light emission accumulation time $T_{xy}$ of each display pixel 13 at the reference current. The measurement signal processing circuit 27 obtains, for example, the light emission accumulation time $T_{xy}$ of each display pixel 13 at the reference current as will be described below.

Figure 13:
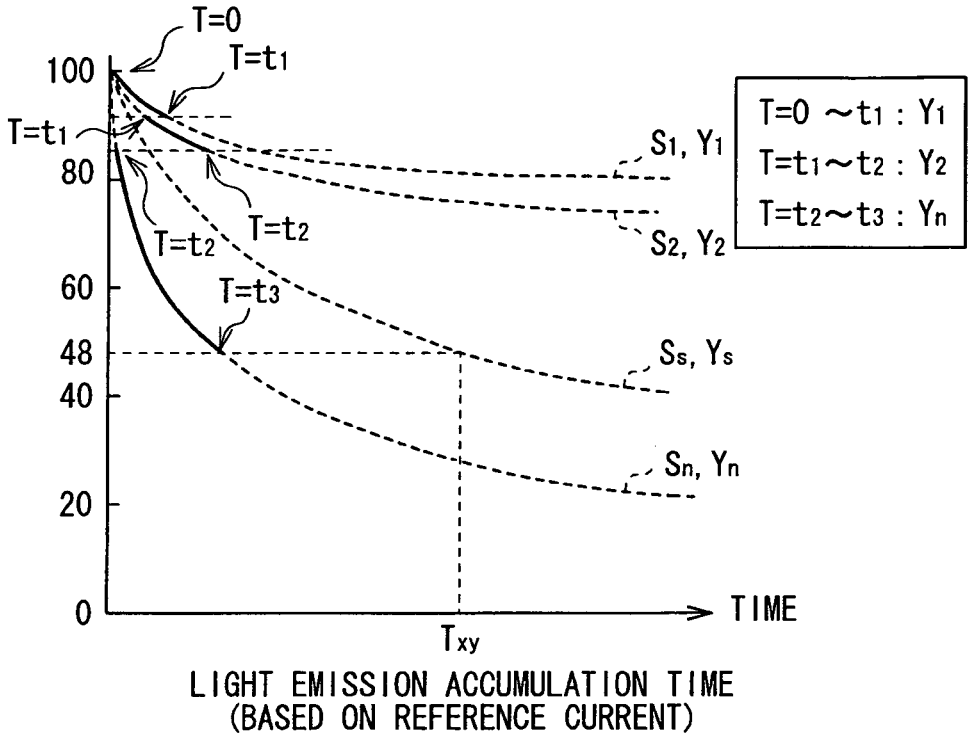
FIG. 13 is a conceptual view for explaining an example of a deriving method of an light emission accumulation time $T_{xy}$ in a reference luminance.

FIG. 13 schematically illustrates the deriving process of the light emission accumulation time $T_{xy}$ of each display pixel 13 at the reference luminance. For example, as illustrated in FIG. 13, it is assumed that the luminance of a certain display pixel 13 is changed as the certain display pixel 13 emits light with the initial current $S_1$ (initial luminance $Y_1$) during the time T=0 to $t_1$, emits light with the initial current $S_2$ (initial luminance $Y_2$) during the time T=$t_1$ to $t_2$, and emits light with the initial current $S_n$ (initial luminance $Y_n$) during the time T=$t_2$ to $t_3$. At this time, in a narrow sense, the luminance of this display pixel 13 is deteriorated along the deterioration curve of the initial current $S_1$ during the time T=0 to $t_1$, deteriorated along the deterioration curve of the initial current $S_2$ during the time T=$t_1$ to $t_2$, and deteriorated along the deterioration curve of the initial current $S_n$ during the time T=$t_2$ to $t_3$. As a result, it is assumed that the luminance of this display pixel 13 is deteriorated to 48%, for example, as illustrated in FIG. 13. Therefore, by obtaining the time when the deterioration ratio in the current deterioration curve ($I_s$ (t)) of the reference pixel becomes 48%, it may be possible to obtain the light emission accumulation time $T_{xy}$ of each display pixel 13 at the reference luminance. In this manner, by tracking the current deterioration curve in each gray scale in accordance with the intensity (gray scale) of the input signal, it may be possible to obtain the light emission accumulation time $T_{xy}$ of each display pixel 13 at the reference luminance, and the current deterioration ratio of each display pixel 13.

(Derivation of Correction Amount)

Next, from the obtained light emission accumulation time $T_{xy}$ (or the predicted current deterioration ratio of each display pixel 13), and the gamma characteristic of the display panel 10, the measurement signal processing circuit 27 derives the correction amount to the video signal. The measurement signal processing circuit 27 obtains the correction amount to the video signal, for example, as will be described below.

Figure 14:
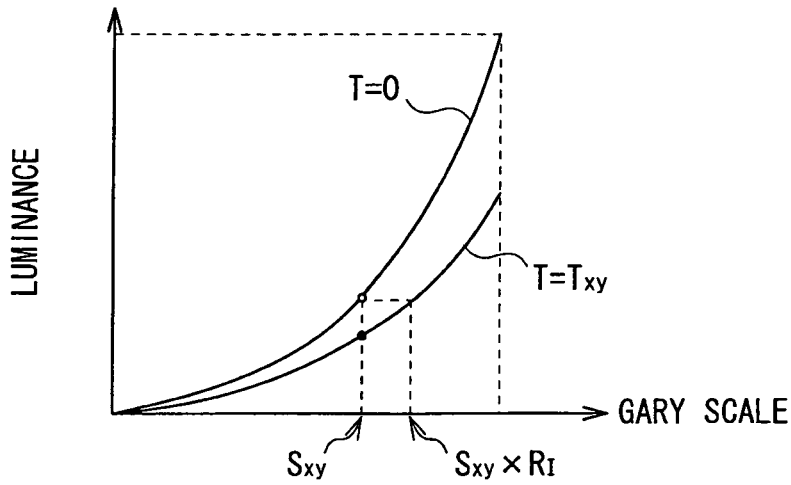
FIG. 14 is a conceptual view for explaining an example of a deriving method of a current correction amount $R_I$.

FIG. 14 illustrates an example of the relationship between the gray scale (value of the video signal 20A) and the luminance at T=0, and $T_{xy}$. The gray scale-luminance characteristic at T=0 is a so-called gamma characteristic. The gray scale-luminance characteristic at T=$T_{xy}$ is obtained by attenuating the luminance for all the gray scales to 48% with respect to the gamma characteristic. Here, in a certain display pixel 13, when the value of the video signal 20A is $S_{xy}$, it can be seen that the luminance of this display pixel 13 has a value corresponding to a white circle in the figure in the initial state. In other words, when the light emission accumulation time $T_{xy}$ is passed from the initial state, it is predictable that the luminance of this display pixel 13 has a value obtained by attenuating the luminance in the initial state to 48%.

Thus, the measurement signal processing circuit 27 derives the current correction amount $R_1$ to be subjected to the video signal 20A so that the luminance when the light emission accumulation time $T_{xy}$ is passed from the initial state is identical to the luminance in the initial state. Specifically, the measurement signal processing circuit 27 derives the current correction amount $R_1$ by using the following equation.

$$R_I = G_I^{\frac{1}{r}} \qquad \text{Equation 5}$$

In the Equation 5,$G_I$ represents a current correction gain, and it is 1/0.48 in the example above. "r" represents an index number (gamma value) of the gamma characteristic.

Finally, the measurement signal processing circuit 27 stores the current correction amount $R_1$ as the correction information 27A in the storage circuit 28. In this manner, the measurement signal processing circuit 27 corrects the efficiency deterioration caused by deterioration of the semiconductor element such as the drive transistor $Tr_1$' included in the pixel circuit 32.

(Efficiency Correction)

Further, the dummy pixel drive circuit 25 allows the constant currents having magnitudes different each other to flow through each dummy pixel 18 in response to (in synchronization with) the input of the control signal 21A, thereby allowing each dummy pixel 18 to emit light. For example, in the case where the number of the dummy pixels 18 is n, the dummy pixel drive circuit 25 allows a constant current to flow through the first dummy pixel 18 so that the initial luminance is $Y_1$, allows a constant current to flow through the second dummy pixel 18 so that the initial luminance is $Y_2$ (>$Y_1$), allows a constant current to flow through the $i^{th}$ dummy pixel 18 so that the initial luminance is $Y_i$ (>$Y_{i-1}$), and allows a constant current to flow through the $n^{th}$ dummy pixel 18 so that the initial luminance is $Y_n$ ($>Y_{n-1}$). The dummy pixel drive circuit 25 measures, for example, the time during the current is passed through each dummy pixel 18.

Figure 15:
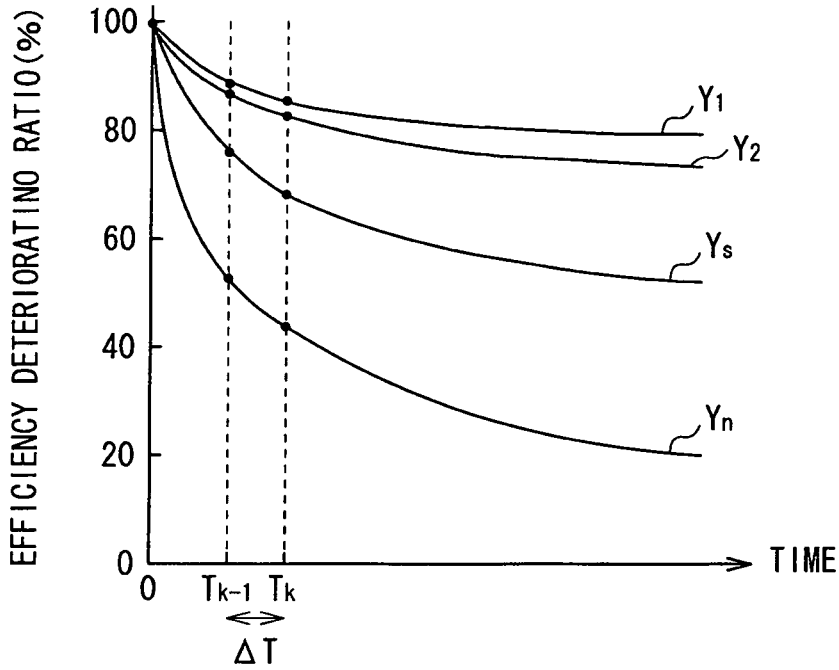
FIG. 15 is a characteristic view illustrating an example of a temporal change of an efficiency deterioration ratio for each initial luminance.

In addition, even in the case where the constant current is continued to be flown through each dummy pixel 18, the luminance of each dummy pixel 18 is gradually reduced with the passage of the time, for example, as illustrated in FIG. 15. This is because the organic EL element 17 included in each dummy pixel 18 has a property to deteriorate in accordance with the current application time (light emission accumulation time), and the light emission efficiency is deteriorated in accordance with the progress of the deterioration. In addition, $Y_s$ in FIG. 15 represents the initial luminance of the pixel set as the reference pixel (will be described later) in each dummy pixel 18.

Figure 16:
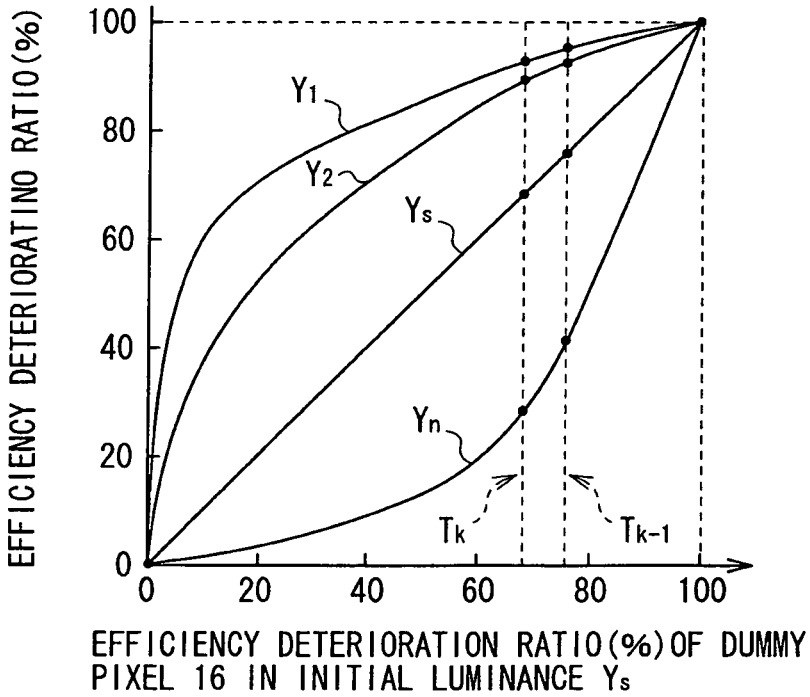
FIG. 16 is a relationship view illustrating an example of the relationship between the efficiency deterioration ratio and the efficiency deterioration ratio of a dummy pixel of an initial luminance $Y_s$.

The change of the efficiency deterioration ratio of each dummy pixel 18 is not uniform. For example, as illustrated in FIG. 16, when the efficiency deterioration ratio of the pixel (dummy pixel 18) set as the reference pixel is indicated on the abscissa axis, it can be seen that the change of the efficiency deterioration ratio of the dummy pixel 18 having the initial luminance smaller than the initial luminance $Y_S$ of the reference pixel is more gradual than the change of the efficiency deterioration of the reference pixel at the beginning. On the other hand, it can be seen that the change of the efficiency deterioration ratio of the dummy pixel 18 having the initial luminance larger than the initial luminance $Y_S$ of the reference pixel is steeper than the change of the efficiency deterioration of the reference pixel at the beginning. The change of the efficiency deterioration ratio of each dummy pixel 18 exemplified in FIG. 16 is represented by the following equation.

$$D_i = D_s^{n(Yi, Ys)} \qquad \text{Equation 6}$$

In the Equation 6, $D_i$ represents the efficiency deterioration ratio of the $i^{th}$ dummy pixel 18. $D_s$ represents the efficiency deterioration ratio of the reference pixel. n ($Y_i$, $Y_s$) represents a power coefficient of the luminance of the $i^{th}$ dummy pixel 18 to the luminance of the reference pixel. The power coefficient n ($Y_i$, $Y_s$) is, for example, derived by dividing (Log ($Y_i$ ($T_k$))−Log ($Y_i$ ($T_{k-1}$)) by (Log ($Y_s(T_k)$)−Log ($Y_s(T_{k-1})$), for example, as indicated in the following equation.

$$n(Y_i, Y_s) = \frac{\mathrm{Log}(Y_i(T_k)) - \mathrm{Log}(Y_i(T_{k-1}))}{\mathrm{Log}(Y_s(T_k)) - \mathrm{Log}(Y_s(T_{k-1}))} \qquad \text{Equation 7}$$

In the Equation 7, Log ($Y_s(T_k)$) represents a logarithm of $Y_s(T_k)$, Log ($Y_s(T_{k-1})$) represents a logarithm of $Y_s$ ($T_{k-1}$), Log ($Y_i(T_k)$) represents a logarithm of $Y_i$ ($T_k$), and Log ($Y_i$ ($T_{k-1}$)) represents a logarithm of $Y_i(T_{k-1})$.

In the Equation 7, $Y_s(T_k)$ represents the light reception signal 19A (luminance information) of the reference pixel at the time $T_k$, and corresponds to the latest luminance information in the luminance information of the reference pixel. $Y_s(T_{k-1})$ represents the light reception signal 19A (luminance information) of the reference pixel at the time $T_{k-1}$(<time $T_k$), and corresponds to the non-latest luminance information in the luminance information of the reference pixel. $Y_i$ ($T_k$) represents the light reception signal 19A (luminance information) of the $i^{th}$ dummy pixel 18 at the time $T_k$, and corresponds to the latest luminance information in the luminance information of the $i^{th}$ dummy pixel 18 (non-reference pixel). $Y_i(T_{k-1})$ represents the light reception signal 19A (luminance information) of the $i^{th}$ dummy pixel 18 at the time $T_{k-1}$, and corresponds to the non-latest luminance information in the luminance information of the $i^{th}$ dummy pixel 18 (non-reference pixel). The relationship between the time $T_{k-1}$ and the time $T_k$ is, for example, represented by the following equation.

$$T_k = T_{k-1} + \Delta T_2 \qquad \text{Equation 8}$$

In the Equation 8, $\Delta T_2$ represents a sampling period. Here, the sampling period $\Delta T_2$ indicates, for example, a cycle in which the measurement signal processing circuit 27 derives the value of the denominator and the value of the numerator on the right side of the Equation 7. The measurement signal processing circuit 27 sets the sampling period $\Delta T_2$ to be constant at any time.

Figure 17:
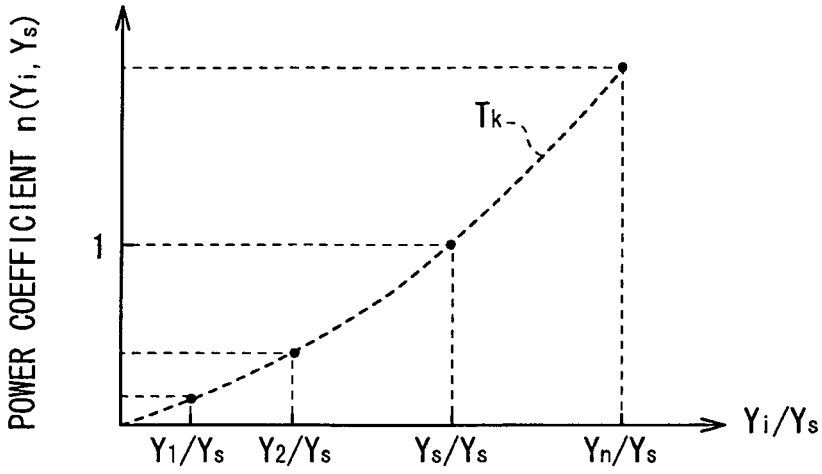
FIG. 17 is a relationship view illustrating an example of the relationship between a power coefficient n ($Y_i$, $Y_s$) and an initial luminance ratio $Y_i/Y_s$.
Figure 18:
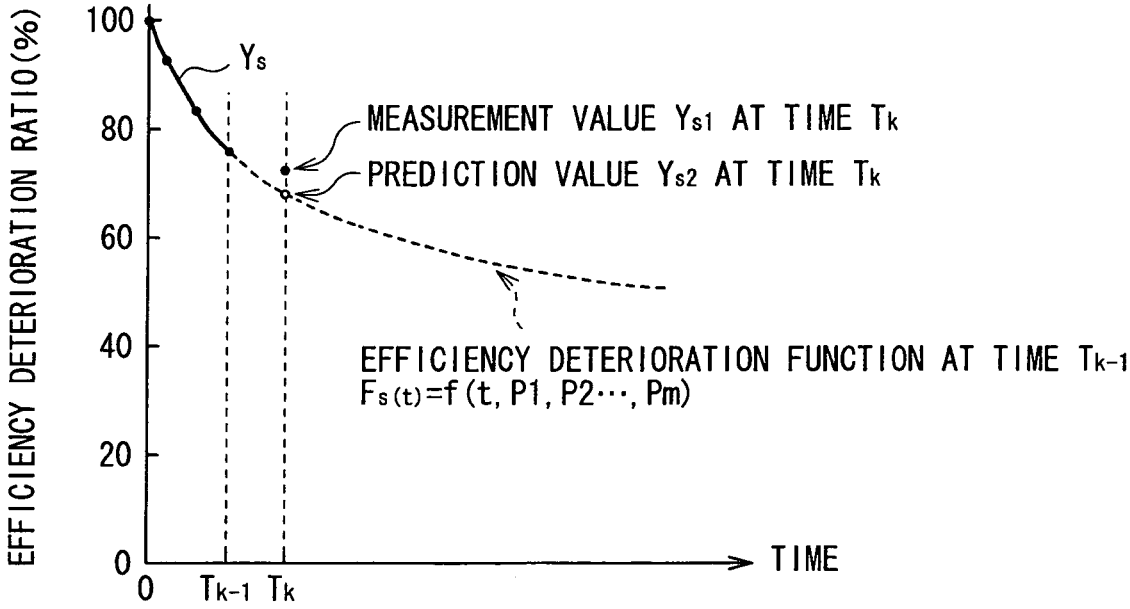
FIG. 18 is a relationship view illustrating an example of the relationship between a prediction value $Y_{s2}$ of the efficiency deterioration ratio at the time $T_k$, and a measurement value $Y_{s1}$ of the efficiency deterioration ratio at the time $T_k$.

For example, as illustrated in FIG. 17, when the abscissa axis indicates the ratio ($Y_i/Y_s$) of the initial luminance $Y_i$ of each dummy pixel 16 to the initial current $Y_s$ of the reference pixel, the power coefficient n ($Y_i$, $Y_s$) derived in the manner described above draws a rightward rising curve which increases with an increase of the initial luminance $Y_i$, at the time $T_k$. In addition, as can be obviously seen from the Equation 7, the power coefficient n ($Y_i$, $Y_s$) is 1 in $Y_s/Y_s$.

Next, with reference to FIGS. 18 to 24, the deriving method of the efficiency correction amount $R_y$ used for correcting the video signal 20A will be described.

(Initial Setting)

First, the initial setting will be described. The measurement signal processing circuit 27 sets one pixel in the plurality of dummy pixels 18 as the reference pixel. In this embodiment, the reference pixel is not change to another dummy pixel 18 (non-reference pixel), and the same dummy pixel 18 is always set as the reference pixel.

Next, from the light receiving element group 19, the measurement signal processing circuit 27 obtains the light reception signal 19A at the times $T_1$ and $T_2$. Specifically, from the light receiving element group 19, the measurement signal processing circuit 27 obtains the light reception signal 19A of the reference pixel as being one pixel in the plurality of dummy pixels 18, at the times $T_1$ and $T_2$. Further, from the light receiving element group 19, the measurement signal processing circuit 27 obtains the light reception signal 19A of the plurality of non-reference pixels as being all the pixels except the reference pixel in the plurality of dummy pixels 18, at the times $T_1$ and $T_2$. Next, the measurement signal processing circuit 27 derives, from the luminance information of the reference pixel, the efficiency deterioration information (Log ($Y_s(T_2)$)−Log ($Y_s(T_i)$)) of the reference pixel, and derives, from the luminance information of each non-reference pixel, the efficiency deterioration information (Log ($Y_i(T_2)$)−Log ($Y_i(T_1)$)) of each non-reference pixel.

Next, from the efficiency deterioration information of the reference pixel, and the efficiency deterioration information of each non-reference pixel, the measurement signal processing circuit 27 derives the power coefficient n ($Y_1$, $Y_s$) of the luminance information of each non-reference pixel to the luminance information of the reference pixel at the time $T_2$. Next, from the luminance information of the reference pixel, the measurement signal processing circuit 27 derives an efficiency deterioration function $F_s$ (t) representing the temporal change of the luminance of the reference pixel at the time $T_2$. Further, from the efficiency deterioration function $F_s$ (t) and the power coefficient n ($Y_1$, $Y_s$), the measurement signal processing circuit 27 derives an efficiency deterioration function $F_i$ (t) representing the temporal change of the luminance of each non-reference pixel, at the time $T_2$. In this manner, the measurement signal processing circuit 27 derives the efficiency deterioration functions $F_s$ (t), and $F_i$ (t) at the time $T_2$ by using the initial luminance information.

(Data Update)

Next, the data update will be described. From the light receiving element group 19, the measurement signal processing circuit 27 obtains the light reception signal 19A of the reference pixel, and the light reception signal 19A of the plurality of non-reference pixels at the times $T_{k-1}$ and $T_k$. The value (measurement value) of the light reception signal 19A of the reference pixel at this time is regarded as $Y_{s1}$ (refer to FIG. 18). Next, from the efficiency deterioration function $F_s$ (t) at the time $T_{k-1}$, the measurement signal processing circuit 27 predicts the luminance information of the reference pixel at the time $T_k$. The prediction value at this time is regarded as $Y_{s2}$ (refer to FIG. 18). Next, from the comparison between the measurement value $Y_{s1}$ and the prediction value $Y_{s2}$, the measurement signal processing circuit 27 determines whether or not the measurement value $Y_{s1}$ and the prediction value $Y_{s2}$ are coincident with each other. As a result, for example, in the case where the measurement value $Y_{s1}$ and the prediction value $Y_{s2}$ are coincident with each other, the measurement signal processing circuit 27 regards the efficiency deterioration function $F_s$ (t) at the time $T_{k-1}$ as the efficiency deterioration function $F_s$ (t) at the time $T_k$. On the other hand, for example, in the case where the measurement signal processing circuit 27 determines that the measurement value $Y_{s1}$ is different from the prediction value $Y_{s2}$ based on the comparison between the measurement value $Y_{s1}$ and the prediction value $Y_{s2}$, the measurement signal processing circuit 27 derives the efficiency deterioration function $F_s$ (t) at the time $T_k$ from the luminance information of the reference pixel.

Next, from the luminance information of the reference pixel, the measurement signal processing circuit 27 derives the efficiency deterioration information (Log ($Y_s(T_k)$)−Log ($Y_s(T_{k-1})$)) of the reference pixel. Further, from the luminance information of the plurality of non-reference pixels, the measurement signal processing circuit 27 derives the efficiency deterioration information (Log ($Y_i$ ($T_k$))−Log ($Y_i$ ($T_{k-1}$))) of each non-reference pixel. Next, from the efficiency deterioration information of the reference pixel, and the efficiency deterioration information of each non-reference pixel, the measurement signal processing circuit 27 derives the power coefficient n ($Y_i$, $Y_s$) at the time $T_k$.

Figure 19:
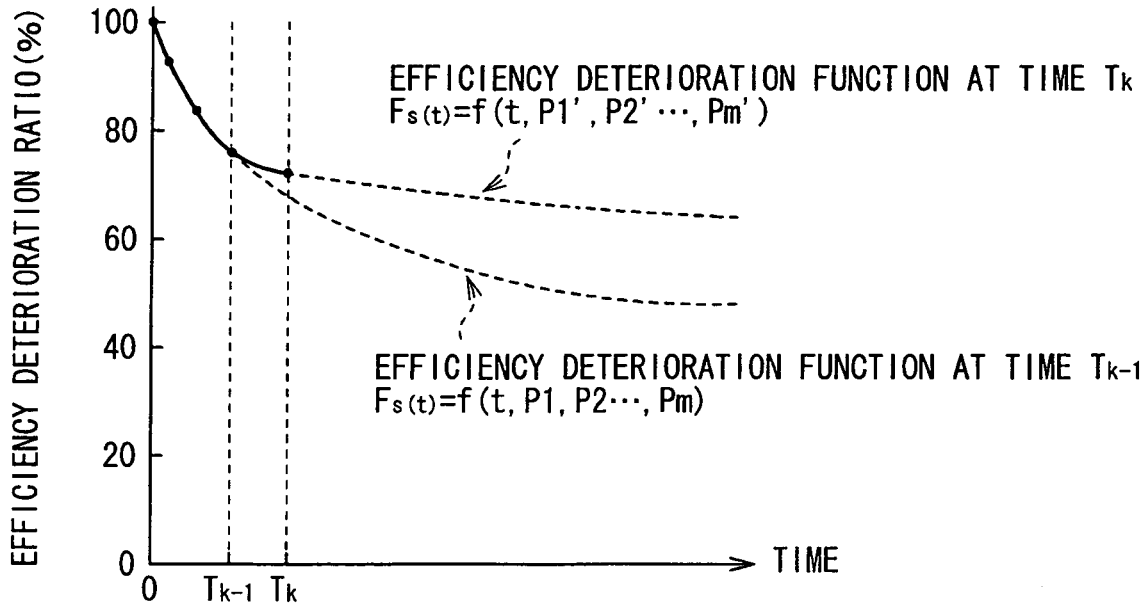
FIG. 19 is a relationship view illustrating an example of the relationship between an efficiency deterioration function $F_s$ (t) at the time $T_{k-1}$, and an efficiency deterioration function $F_s$ (t) at the time $T_k$.
Figure 20:
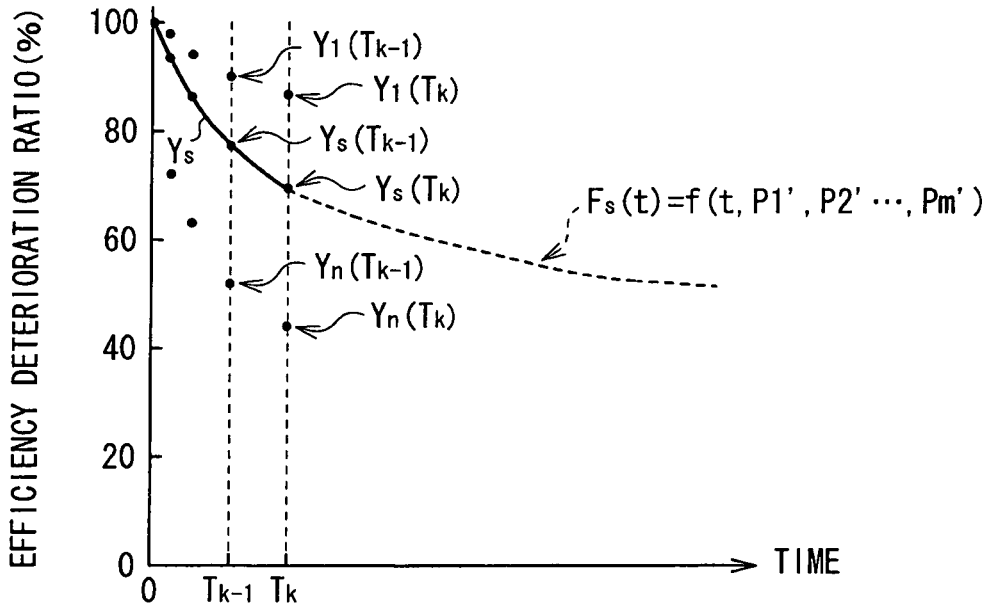
FIG. 20 is a conceptual view for explaining an example of a calculating method of the power coefficient.
Figure 21:
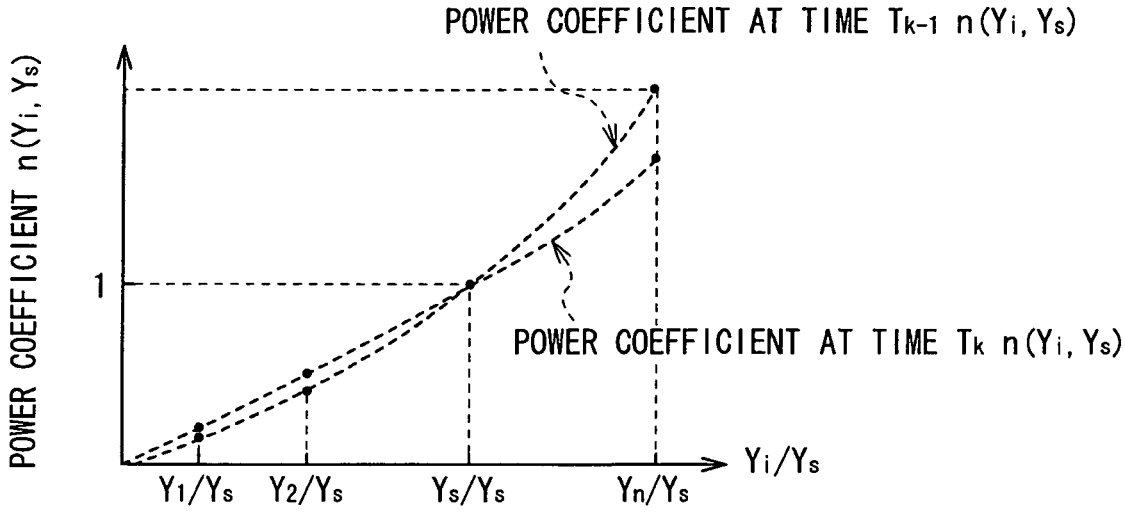
FIG. 21 is a relationship view illustrating an example of the relationship between the power coefficient n ($Y_i$, $Y_s$) at the time $T_{k-1}$, and a power coefficient n ($Y_i$, $Y_s$) at the time $T_k$.

Next, the measurement signal processing circuit 27 updates the parameters (for example, p1, p2, . . . , pm) of the efficiency deterioration function $F_s$ (t) at the time $T_{k-1}$ to parameters (for example, p1', p2', . . . , pm') of the efficiency deterioration function $F_s$ (t) at the time $T_k$ (refer to FIG. 19). In other words, the measurement signal processing circuit 27 updates the parameters of the efficiency deterioration function $F_s$(t) in accordance with the latest luminance information ($Y_s(T_k)$) in the luminance information of the reference pixel, and the non-latest luminance information ($Y_s$ ($T_{k-1}$)) in the luminance information of the reference pixel. The measurement signal processing circuit 27 stores, for example, the parameters of the newly-obtained efficiency deterioration function $F_s$ (t) in the storage circuit 28.

Figure 22:
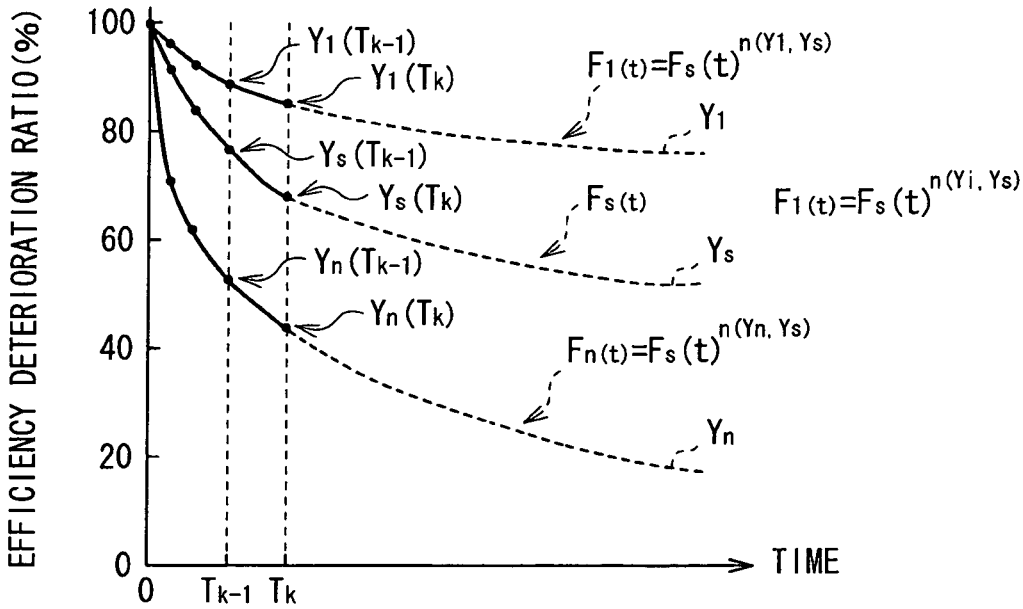
FIG. 22 is a conceptual view for explaining an example of a calculating method of an efficiency deterioration function $F_i$ (t).

Next, from the efficiency deterioration function $F_s$ (t) at the time $T_k$ (refer to FIG. 20), and the power coefficient n ($Y_i$, $Y_s$) (refer to FIG. 21), the measurement signal processing circuit 27 derives the efficiency deterioration function $F_i$ (t) at the time $T_k$ (refer to FIG. 22). Specifically, the measurement signal processing circuit 27 derives the efficiency deterioration function $F_i$ (t) at the time $T_k$ by using the following equation.

$$F_i(t)=F_s(t)^{n(Y_i,Y_s)} \quad \text{Equation 9}$$

Next, the measurement signal processing circuit 27 updates the parameters of the efficiency deterioration function $F_i$ (t) of each non-reference pixel at the time $T_{k-1}$ to the parameters of the efficiency deterioration function $F_i$ (t) of each non-reference pixel at the time $T_k$. The measurement signal processing circuit 27 stores, for example, the parameters of the newly-obtained efficiency deterioration function $F_i$ (t) in the storage circuit 28.

(Prediction of Efficiency Deterioration Ratio)

Next, the measurement signal processing circuit 27 predicts the efficiency deterioration ratio of each display pixel 13 during the time until the next sampling period comes. Specifically, from the efficiency deterioration function $F_s$ (t), the efficiency deterioration function $F_i$ (t), and the history of the video signal 20A of each display pixel 13, the measurement signal processing circuit 27 derives the light emission accumulation time $T_{xy}$ of each display pixel 13 at the reference luminance. The measurement signal processing circuit 27 obtains, for example, the light emission accumulation time $T_{xy}$ of each display pixel 13 at the reference luminance as will be described below.

Figure 23:
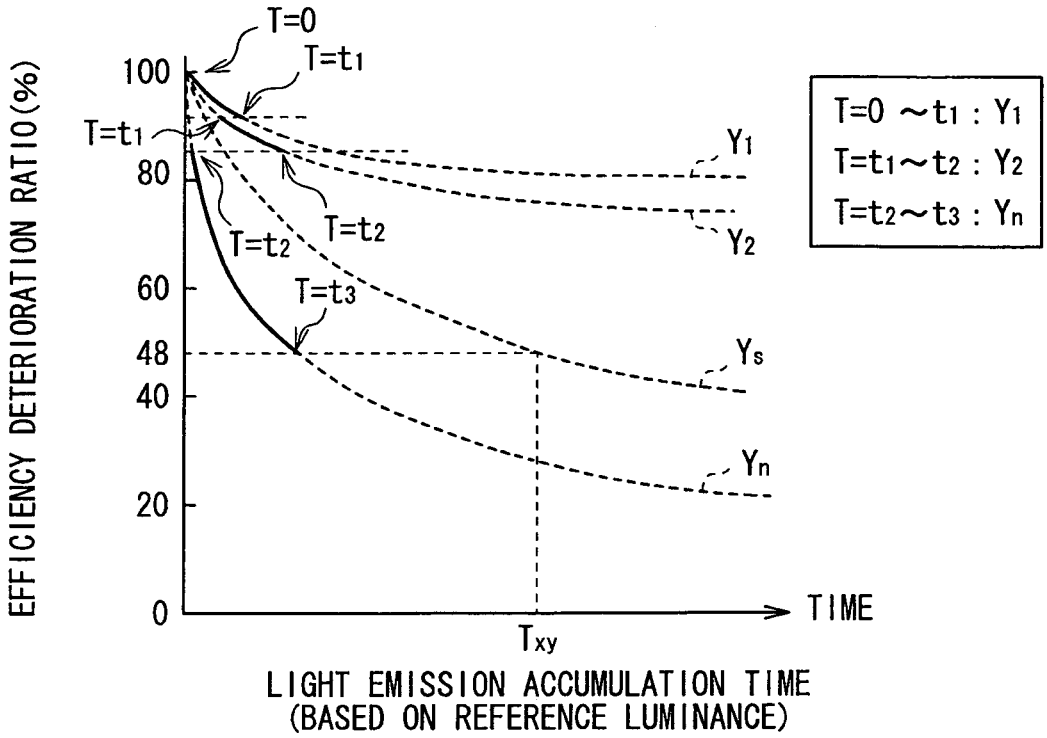
FIG. 23 is a conceptual view for explaining an example of a deriving method of the light emission accumulation time $T_{xy}$ in the reference luminance.

FIG. 23 schematically illustrates the deriving process of the light emission accumulation time $T_{xy}$ of each display pixel 13 at the reference luminance. For example, as illustrated in FIG. 23, it is assumed that the luminance of a certain display pixel 13 is changed as the certain display pixel 13 emits light with the initial luminance $Y_1$ during the time T=0 to $t_1$, emits light with the initial luminance $Y_2$ during the time T =$t_1$ to $t_2$, and emits light with the initial luminance $Y_n$ during the time T=$t_2$ to $t_3$. At this time, in a narrow sense, the luminance of this display pixel 13 is deteriorated along the deterioration curve of the initial luminance $Y_1$ during the time T=0 to $t_1$, deteriorated along the deterioration curve of the initial luminance $Y_2$ during the time T=$t_1$ to $t_2$, and deteriorated along the deterioration curve of the initial luminance $Y_n$ during the time T=$t_2$ to $t_3$. As a result, it is assumed that the luminance of this display pixel 13 is deteriorated to 48%, for example, as illustrated in FIG. 23. Therefore, by obtaining the time when the deterioration ratio in the efficiency deterioration curve ($F_s$ (t)) of the reference pixel becomes 48%, it may be possible to obtain the light emission accumulation time $T_{xy}$ of each display pixel 13 at the reference luminance. In this manner, by tracking the efficiency deterioration curve in each gray scale in accordance with the intensity (gray scale) of the input signal, it may be possible to obtain the light emission accumulation time $T_{xy}$ of each display pixel 13 at the reference luminance, and the efficiency deterioration ratio of each display pixel 13.

(Derivation of Correction Amount)

Next, from the obtained light emission accumulation time $T_{xy}$ (or the predicted efficiency deterioration ratio of each display pixel 13), and the gamma characteristic of the display panel 10, the measurement signal processing circuit 27 derives the correction amount to the video signal. The measurement signal processing circuit 27 obtains the correction amount to the video signal, for example, as will be described below.

Figure 24:
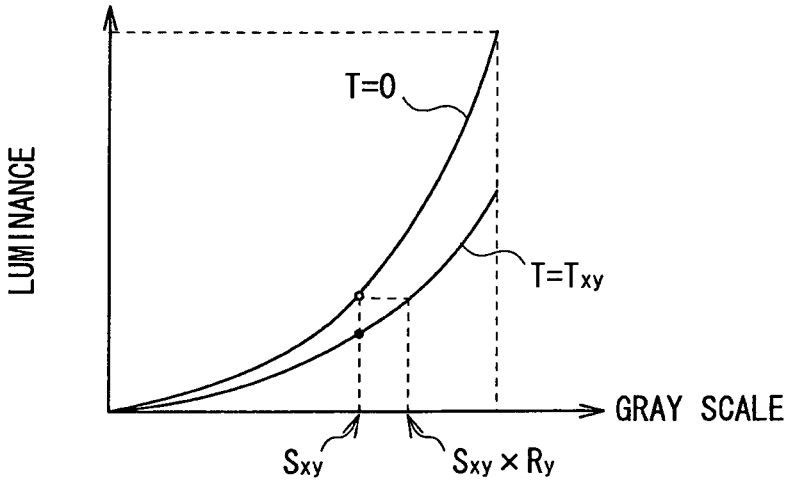
FIG. 24 is a conceptual view for explaining an example of a deriving method of an efficiency correction amount $R_y$.

FIG. 24 illustrates an example of the relationship between the gray scale (value of the video signal 20A), and the luminance at T=0, and $T_{xy}$. The gray scale-luminance characteristic at T=0 is a so-called gamma characteristic. The gray scale-luminance characteristic at T=$T_{xy}$ is obtained by attenuating the luminance to 48% for all the gray scales with respect to the gamma characteristic. Here, in a certain display pixel 13, when the value of the video signal 20A is $S_{xy}$, it can be seen that the luminance of this display pixel 13 has a value corresponding to a white circle in the figure in the initial state. In other words, when the light emission accumulation time $T_{xy}$ is passed from the initial state, it is predictable that the luminance of this display pixel 13 has a value obtained by attenuating the luminance in the initial state to 48%.

Thus, the measurement signal processing circuit 27 derives the efficiency correction amount $R_y$ to be subjected to the video signal 20A so that the luminance when the light emission accumulation time $T_{xy}$ is passed from the initial state is identical to the luminance in the initial state. Specifically, the measurement signal processing circuit 27 derives the efficiency correction amount $R_y$ by using the following equation.

$$R_Y = G_Y^{\frac{1}{\gamma}} \qquad \text{Equation 10}$$

In the Equation 10, $G_y$ represents a luminance correction gain, and it is 1/0.48 in the example above.

Finally, the measurement signal processing circuit 27 stores the efficiency correction amount $R_y$ as the correction information 27A in the storage circuit 28. In this manner, the measurement signal processing circuit 27 corrects the deterioration of the light emission efficiency caused by the deterioration of the organic EL element 17 included in each dummy pixel 18.

(Operations and Effects)

Next, operations and effects of the display deice 1 of this embodiment will be described. The video signal 20A and the synchronization signal 20B are input to the display device 1. Then, each display pixel 13 is driven by the signal line drive circuit 23 and the scanning line drive circuit 24, and a video in response to the video signal 20A of each display pixel 13 is displayed on the display region 12. Meanwhile, signal voltages $V_{sigi}$ (constant value) having magnitudes different from each other are applied to the signal lines DTL' connected to each dummy pixel 16 by the dummy pixel drive circuit 25, and each dummy pixel 16 emits light with gray scales different from each other. As a result, the current signal 26A corresponding to the current value flowing through the organic EL element 14 of each dummy pixel 16 is output from the current measurement circuit 26. Further, when each dummy pixel 18 is driven by the dummy pixel drive circuit 25, the light receiving element group 19 is also driven at the same time. Therefore, the constant currents having magnitudes different from each other are allowed to flow through each dummy pixel 18, each dummy pixel 18 emits light with the luminance according to the magnitude of the constant current, and the light emitted from each dummy pixel 18 is detected in the light receiving element group 19. As a result, the light reception signal 19A corresponding to the light emitted from each dummy pixel 18 is output from the light receiving element group 19. Next, the following process is performed by the measurement signal processing circuit 27.

In other words, the power coefficient n ($S_i$, $S_s$) of the current signal 26A (current information) of the non-reference pixel to the current signal 26A (current information) of the reference pixel is derived from the current signal 26A. Next, the current deterioration function $I_s(t)$ of the reference pixel is derived from the current information of the reference pixel, and the current deterioration function $I_i$ (t) of the non-reference pixel is derived from the current deterioration function $I_s(t)$ and the power coefficient n ($S_i$, $S_s$). Next, by utilizing the current deterioration function $I_s$ (t), the current deterioration function $I_i$ (t), and the history of the video signal 20A of each display pixel 13, the light emission accumulation time $T_{xy}$ of each display pixel 13 at the reference current, and the current deterioration ratio of each display pixel 13 are predicted. Next, the current correction amount $R_I$ is applied to the video signal 20A of each display pixel 13 so that the luminance when the light emission accumulation time $T_{xy}$ is passed from the initial state is identical to the luminance in the initial state.

Further, the power coefficient n ($Y_i$, $Y_s$) of the light reception signal 19A (luminance information) of the non-reference pixel to the light reception signal 19A (luminance information) of the reference pixel is derived from the light reception signal 19A. Next, the efficiency deterioration function $F_s$ (t) of the reference pixel is derived from the luminance information of the reference pixel, and the efficiency deterioration function $F_i$ (t) of the non-reference pixel is derived from the efficiency deterioration function $F_s$ (t) and the power coefficient n ($Y_i$, $Y_s$). Next, by utilizing the efficiency deterioration function $F_s$ (t), the efficiency deterioration function $F_i$ (t), and the history of the video signal 20A of each display pixel 13, the light emission accumulation time $T_{xy}$ of each display pixel 13 at the reference current, and the efficiency deterioration ratio of each display pixel 13 are predicted. Next, the efficiency correction amount $R_y$ is applied to the video signal 20A of each display pixel 13 so that the luminance when the light emission accumulation time $T_{xy}$ is passed from the initial state is identical to the luminance in the initial state.

In this manner, in this embodiment, by utilizing the current deterioration function $I_s$ (t), the current deterioration function $I_i$ (t) obtained from the current deterioration function $I_s$ (t) and the power coefficient n ($S_i$, $S_s$), and the history of the video signal 20A of each display pixel 13, the current deterioration ratio of each display pixel 13 is predicted. Further, by utilizing the efficiency deterioration function $F_s$ (t), the efficiency deterioration function $F_i$ (t) obtained from the efficiency deterioration function $F_s$ (t) and the power coefficient n ($Y_i$, $Y_s$), and the history of the video signal 20A of each display pixel 13, the efficiency deterioration ratio of each display pixel 13 is predicted. Thereby, it may be possible to predict the efficiency deterioration of each display pixel 13 with a high accuracy, and thus it may be possible to apply the appropriate correction amount (the current correction amount $R_1$ and the efficiency correction amount $R_y$) to the video signal 20A of each display pixel 13 so that the luminance of each display pixel 13 is identical to the luminance in the initial state. As a result, it may be possible to accurately prevent seizure.

Further, in this embodiment, it may be possible to predict the current deterioration ratio and the efficiency deterioration ratio of each display pixel 13 by using the data ($S_s(T_k)$, $S_s(T_{k-1})$, $Y_s(T_k)$, and $Y_s(T_{k-1})$) at the time of observation. Therefore, it may be possible to predict the efficiency deterioration of each display pixel with a high accuracy without an observation for a long time. Therefore, the predicting method of this embodiment is extremely practical. Further, in this embodiment, since it may be possible to predict the efficiency deterioration ratio of each display pixel 13 by using the data at the time of observation, it may be possible to suppress and reduce the memory amount and the calculation amount which are necessary for the update.

2. Modification

In the foregoing embodiment, although the correction by using both the current correction amount $R_I$ and the efficiency correction amount $R_y$ is performed on the video signal 20A of each display pixel 13, the correction by using only one of the current correction amount $R_I$ and the efficiency correction amount $R_y$ may be performed.

Further, in the foregoing embodiment, although all the dummy pixels 16 of the initial currents $S_1$ to $S_n$ are composed of a single pixel of a set of organic EL elements 14R, 14G and 14B, each dummy pixel 16 (low-current pixel) in which the initial current $S_i$ is low may be composed of a plurality of dummy pixels (second dummy pixels) (not illustrated in the figure). In this case, from the average value of the currents flowing through the organic EL elements 14 which are connected to the plurality of second dummy pixels, the measurement signal processing circuit 27 may derive the denominator or the numerator on the right side of the Equation 2. Therefore, it may be possible to make a measurement error small in the dummy pixel 16 having the low luminance. Thus, it may be possible to predict the efficiency deterioration of the display pixel 13 having the low luminance with a high accuracy. As a result, it may be possible to more accurately prevent the seizure.

Further, in the foregoing embodiment, although all the dummy pixels 18 of the initial luminances $Y_1$ to $Y_n$ are composed of a single pixel of a set of organic EL elements 17R, 17G, and 17B, each dummy pixel 18 (low-luminance pixel) in which the initial luminance $Y_i$ is low may be composed of a plurality of dummy pixels (third dummy pixels) (not illustrated in the figure). In this case, from the average value of the luminance of the plurality of third dummy pixels, the measurement signal processing circuit 27 may derive the denominator or the numerator on the right side of the Equation 7. Therefore, it may be possible to make a measurement error small in the dummy pixel 18 having the low luminance. Thus, it may be possible to predict the efficiency deterioration of the display pixel 13 having the low luminance with a high accuracy. As a result, it may be possible to more accurately prevent the seizure.

In the foregoing embodiment, although the specific dummy pixel 16 is set as the reference pixel at any time, the dummy pixel 16 which has been set as the non-reference pixel may be set as the reference pixel, if necessary. For example, when the measurement signal processing circuit 27 detects that the current flowing through the organic EL element 14 which is connected to the reference pixel has a value equal to or lower than a predetermined value, the measurement signal processing circuit 27 excludes the dummy pixel 16 which has been set as the reference pixel so far, and sets one pixel in the plurality of non-reference pixels as the new reference pixel. Thereafter, the measurement signal processing circuit 27 derives the denominator and the numerator on the right side of the Equation 2 in the same manner as heretofore. In this case, even in the case where a failure is generated in the reference pixel, it may be possible to continue to predict the efficiency deterioration. Therefore, it may be possible to improve the reliability of the prediction of the efficiency deterioration.

Further, in the foregoing embodiment, although the specific dummy pixel 18 is set as the reference pixel at any time, the dummy pixel 18 which has been set as the non-reference pixel may be set as the reference pixel, if necessary. For example, when the measurement signal processing circuit 27 detects that the luminance of the reference pixel has a value equal to or lower than a predetermined value, the measurement signal processing circuit 27 excludes the dummy pixel 18 which has been set as the reference pixel so far, and sets one pixel in the plurality of non-reference pixels as the new reference pixel. Thereafter, the measurement signal processing circuit 27 derives the denominator and the numerator on the right side of the Equation 7 in the same manner as heretofore. In this case, even in the case where a failure is generated in the reference pixel, it may be possible to continue to predict the efficiency deterioration. Therefore, it may be possible to improve the reliability of the prediction of the efficiency deterioration.

In the foregoing embodiment, although the sampling period $\Delta T_1$ is constant at any time, it may be variable. For example, the measurement signal processing circuit 27 may change the sampling period $\Delta T_1$ according to the light emission accumulation time of the plurality of dummy pixels 16. In that case, for example, when the light emission accumulation time $T_{xy}$ is a long time, and the efficiency deterioration is hardly generated, it may be possible to extend the sampling period $\Delta T_1$. Therefore, it may be possible to suppress and reduce the calculation amount which is necessary for the update.

In the foregoing embodiment, although the sampling period $\Delta T_2$ is constant at any time, it may be variable. For example, the measurement signal processing circuit 27 may change the sampling period $\Delta T_2$ according to the light emission accumulation time of the plurality of dummy pixels 18. In that case, for example, when the light emission accumulation time $T_{xy}$ is a long time, and the efficiency deterioration is hardly generated, it may be possible to extend the sampling period $\Delta T_2$. Therefore, it may be possible to suppress and reduce the calculation amount which is necessary for the update.

In the foregoing embodiment, although the power coefficient n ($S_i$, $S_s$) is derived by using the Equation 2, for example, the power coefficient n ($S_i$, $S_s$) may be derived by using the following equation.

$$n(S_i, S_s) = \frac{S_s(T_k)}{S_i(T_k)} \times \frac{\frac{d}{dt}(S_i(T_k))}{\frac{d}{dt}(S_s(T_k))} \quad \text{Equation 11}$$

$$n(S_i, S_s) = \frac{S_s(T_k)}{S_i(T_k)} \times \frac{S_i(T_k) - S_i(T_{k-1})}{S_s(T_k) - S_s(T_{k-1})} \quad \text{Equation 12}$$

In the Equation 11, the denominator in the second term on the right side represents the deterioration rate of the reference pixel at the time $T_k$. The numerator in the second term on the right side represents the deterioration rate of the non-reference pixel at the time $T_k$. In the Equation 12, the second term on the right side is obtained by dividing the deterioration rate of the reference pixel at the time $T_k$ by the deterioration rate of the non-reference pixel at the time $T_k$.

In the case where the power coefficient n ($S_i$, $S_s$) is derived by using the Equation 11 or the Equation 12, it may be possible to derive the power coefficient n ($S_i$, $S_s$) only with the four arithmetic operations, and calculation of a logarithm like when the Equation 2 is used is not necessary. Therefore, it may be possible to suppress and reduce the calculation amount, in comparison with the case where the power coefficient n ($S_i$, $S_s$) is derived by using the Equation 2.

In the foregoing embodiment, although the power coefficient n ($Y_i$, $Y_s$) is derived by using the Equation 7, for example, the power coefficient n ($Y_i$, $Y_s$) may be derived by using the following equation.

$$n(Y_i, Y_s) = \frac{Y_s(T_k)}{Y_i(T_k)} \times \frac{\frac{d}{dt}(Y_i(T_k))}{\frac{d}{dt}(Y_s(T_k))} \quad \text{Equation 13}$$

$$n(Y_i, Y_s) = \frac{Y_s(T_k)}{Y_i(T_k)} \times \frac{Y_i(T_k) - Y_i(T_{k-1})}{Y_s(T_k) - Y_s(T_{k-1})} \quad \text{Equation 14}$$

In the Equation 13, the denominator in the second term on the right side represents the deterioration rate of the reference pixel at the time $T_k$. The numerator in the second term on the right side represents the deterioration rate of the non-reference pixel at the time $T_k$. In the Equation 14, the second term on the right side is obtained by dividing the deterioration rate of the reference pixel at the time $T_k$ by the deterioration rate of the non-reference pixel at the time $T_k$.

In the case where the power coefficient n $(Y_i, Y_s)$ is derived by using the Equation 13 or the Equation 14, it may be possible to derive the power coefficient n $(Y_i, Y_s)$ only with the four arithmetic operations, and calculation of a logarithm like when the Equation 7 is used is not necessary. Therefore, it may be possible to suppress and reduce the calculation amount, in comparison with the case where the power coefficient n $(Y_i, Y_s)$ is derived by using the Equation 7.

3. Application Examples

Hereinafter, a description will be made on application examples of the display device 1 described in the foregoing embodiment and its modification. The display device 1 of the foregoing embodiment and the like is applicable to display devices in electronic appliances in various fields, in which a video signal input from outside, or a video signal generated inside the display device is displayed as an image or a video, such as a television device, a digital camera, a notebook personal computer, a mobile terminal device such as a mobile phone, and a video camera.

First Application Example

FIG. 25 illustrates an appearance of a television device to which the display device 1 of the foregoing embodiment and the like is applied. The television device includes, for example, a video display screen section 300 including a front panel 310 and a filter glass 320. The video display screen section 300 is composed of the display device 1 of the foregoing embodiment and the like.

Second Application Example

FIGS. 26A and 26B illustrate an appearance of a digital camera to which the display device 1 of the foregoing embodiment and the like is applied. The digital camera includes, for example, a light emitting section 410 for a flash, a display section 420, a menu switch 430, and a shutter button 440. The display section 420 is composed of the display device 1 of the foregoing embodiment and the like.

Third Application Example

Figure 27:
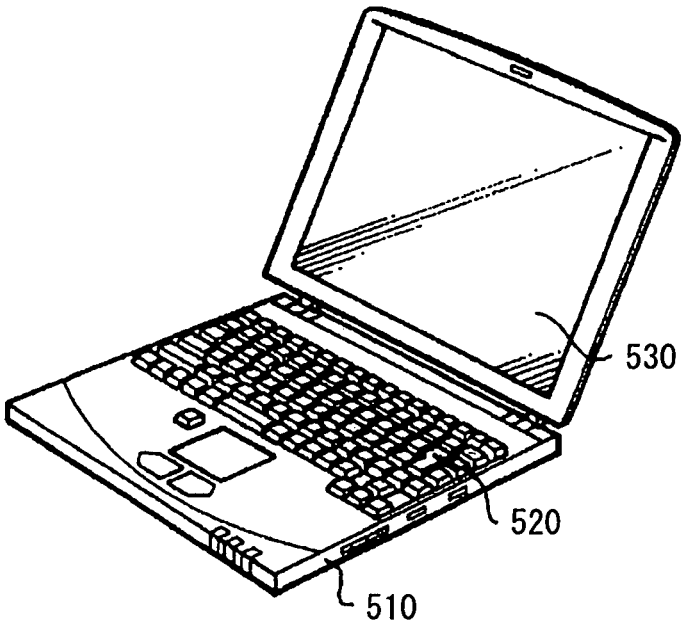
FIG. 27 is a perspective view illustrating an appearance of a third application example.

FIG. 27 illustrates an appearance of a notebook personal computer to which the display device 1 of the foregoing embodiment and the like is applied. The notebook personal computer includes, for example, a main body 510, a keyboard 520 for operation of inputting characters and the like, and a display section 530 for displaying an image. The display section 530 is composed of the display device 1 of the foregoing embodiment and the like.

Fourth Application Example

Figure 28:
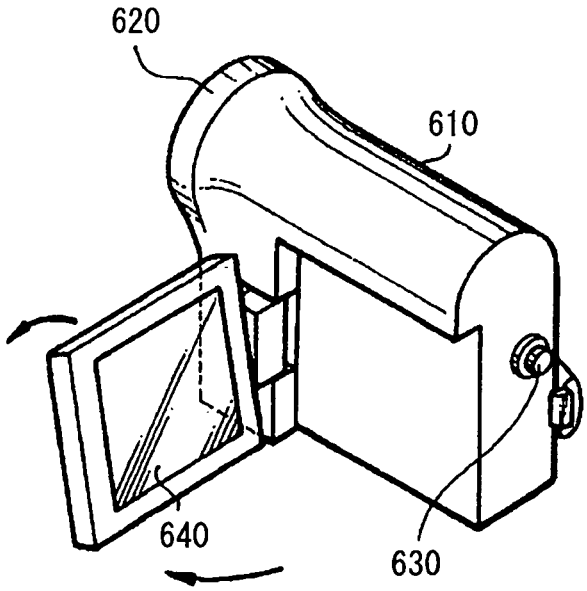
FIG. 28 is a perspective view illustrating an appearance of a fourth application example.
Figures 29A, 29B, 29C, 29D, 29E, 29F, 29G:
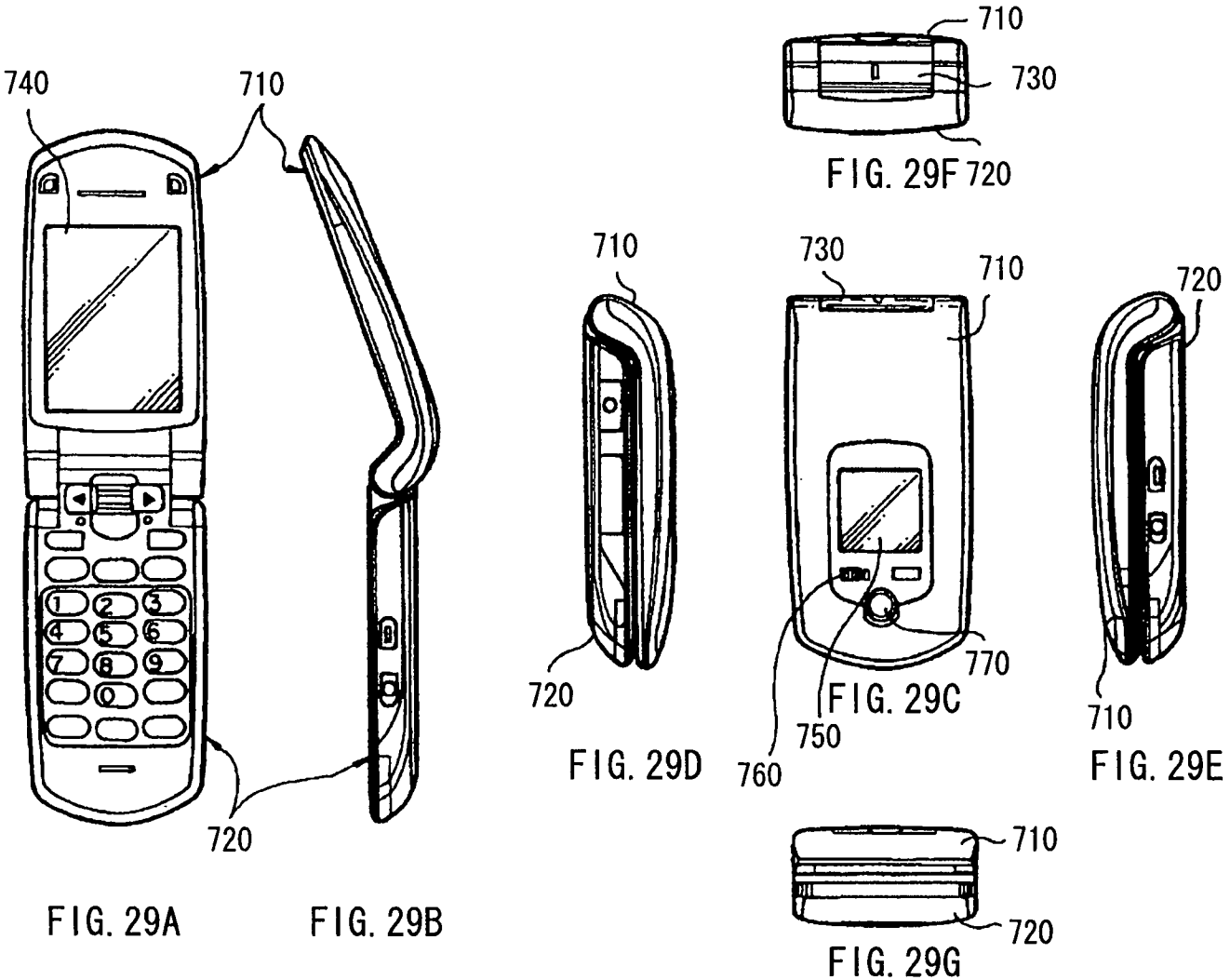
FIG. 29A is an elevation view of a fifth application example unclosed.
FIG. 29B is a side view thereof.
FIG. 29C is an elevation view of the fifth application example closed.
FIG. 29D is a left side view thereof.
FIG. 29E is a right side view thereof.
FIG. 29F is a top face view thereof.
FIG. 29G is a bottom face view thereof

FIG. 28 illustrates an appearance of a video camera to which the display device 1 of the foregoing embodiment and the like is applied. The video camera includes, for example, a main body 610, a lens 620 for capturing an object provided on the front side face of the main body 610, a start/stop switch in capturing 630, and a display section 640. The display section 640 is composed of the display device 1 of the foregoing embodiment and the like.

Fifth Application Example

FIGS. 29A to 29G illustrate an appearance of a mobile phone to which the display device 1 of the foregoing embodiment and the like is applied. In the mobile phone, for example, an upper package 710 and a lower package 720 are jointed by a joint section (hinge section) 730. The mobile phone includes a display 740, a sub-display 750, a picture light 760, and a camera 770. The display 740 or the sub-display 750 is composed of the display device 1 of the foregoing embodiment and the like.

The present application contains subject matter related to that disclosed in Japanese Priority Patent Application JP 2009-217183 filed in the Japanese Patent Office on Sep. 18, 2009, the entire contents of which is hereby incorporated by reference.

It should be understood by those skilled in the art that various modifications, combinations, sub-combinations and alternations may occur depending on design requirements and other factors insofar as they are within the scope of the appended claims or the equivalents thereof.

What is claimed is:

1. A display device comprising:

a display panel including a display region in which a plurality of display pixels are two-dimensionally arranged, and a non-display region in which a plurality of first dummy pixels and a plurality of second dummy pixels are arranged;

a first drive section configured to cause each of the plurality of first dummy pixels to emit light by applying respective signal voltages having magnitudes different from each other to each of the plurality of first dummy pixels;

a second drive section configured to cause each of the plurality of second dummy pixels to emit light by flowing respective constant currents having magnitudes different from each other to each of the plurality of second dummy pixels;

a current measurement section outputting respective current information of each of the plurality of first dummy pixels by detecting currents flowing through each of the plurality of first dummy pixels;

a light reception section outputting respective luminance information of each of the plurality of second dummy pixels by detecting light emitted from each of the plurality of second dummy pixels; and a calculation section deriving from the current information a current deterioration function that estimates current deterioration, and deriving from the luminance information an efficiency deterioration function that estimates efficiency deterioration.

2. The display device according to claim 1, wherein a cycle in which the current deterioration function is derived is set to be shorter than a cycle in which the efficiency deterioration function is derived.

3. The display device according to claim 1, wherein the calculation section predicts a current deterioration ratio of each of the plurality of display pixels from the current deterioration function, and a history of a video signal of each of the plurality of display pixels, and derives a first correction amount to the video signal from the predicted current deterioration ratio of each of the plurality of display pixels, and a gamma characteristic of the display panel.

4. The display device according to claim 3, wherein the calculation section predicts an efficiency deterioration ratio of each of the plurality of display pixels from the efficiency deterioration function, and the history of the video signal of each of the plurality of display pixels, and derives a second correction amount to the video signal from the predicted efficiency deterioration ratio of each of the plurality of display pixels, and the gamma characteristic of the display panel.

5. A display device comprising:

a display panel including display pixels, N first dummy pixels $D_i$, and M second dummy pixels $D'_j$, where N and M are arbitrary integers $\geqq 2$, and i and j are indexes such that $i=\{1, 2, \ldots, N\}$ and $j=\{1, 2, \ldots, M\}$;

a control circuit configured to control light emission of the display pixels, the first dummy pixels $D_i$, and the second dummy pixels $D'_j$, wherein the control circuit is configured to perform a current deterioration detection operation comprising:

causing the first dummy pixels $D_i$ to emit light by applying respective signal voltages $V_i$, having magnitudes different from each other to the first dummy pixels $D_i$;

detecting respective currents $S_i$ that flow through the first dummy pixels $D_i$ as a result of the application of the respective signal voltages $V_i$; and deriving from the detected currents $S_i$ a current deterioration function that estimates current deterioration, and wherein the control circuit is configured to perform an efficiency deterioration detection operation comprising:

causing the second dummy pixels $D'_j$ to emit light by flowing respective constant currents $I_j$ having magnitudes different from each other through the second dummy pixels $D'_j$;

detecting respective amounts of light $Y_j$ that are emitted from the second dummy pixels $D'_j$ as a result of the flowing of the respective constant currents $I_j$; and deriving from the amounts of light $Y_j$ an efficiency deterioration function that estimates efficiency deterioration.

6. The display device according to claim 5, wherein the control circuit is further configured to:

predict a current deterioration ratio of a given one of the display pixels based on the current deterioration function and a history of a video signal of the given one of the display pixels, and derive a first correction amount for correcting a video signal to be input to the given one of the display pixels, the first correction amount being derived from the predicted current deterioration ratio for the given one of the display pixels and a gamma characteristic of the display panel.

7. The display device according to claim 5, wherein the control circuit is further configured to:

predict an efficiency deterioration ratio of a given one of the display pixels based on the efficiency deterioration function and a history of a video signal of the given one of the display pixels, and derive a second correction amount for correcting a video signal to be input to the given one of the display pixels, the second correction amount being derived from the predicted efficiency deterioration ratio for the given one of the display pixels and a gamma characteristic of the display panel.

8. The display device according to claim 5, wherein the control circuit is further configured to:

select one of the first dummy pixels $D_i$ to be a reference first dummy pixel $D_s$;

derive from the detected current $S_s$ corresponding to the reference first dummy pixel $D_s$ a reference current deterioration function $F_s(t)$ having time as an independent variable;

derive respective power coefficients $n(S_i, S_s)$ from the detected currents $S_i$;

derive from the power coefficients $n(S_i, S_s)$ and the reference current deterioration function $F_s(t)$ respective current deterioration functions $F_i(t)$ having time as an independent variable;

predict a current deterioration ratio of a given one of the display pixels based on the current deterioration functions $F_i(t)$ and a history of a video signal of the given one of the display pixels, and derive a first correction amount for correcting a video signal to be input to the given one of the display pixels, the first correction amount being derived from the predicted current deterioration ratio for the given one of the display pixels and a gamma characteristic of the display panel.

9. The display device according to claim 8, wherein the control circuit is further configured to predict the current deterioration ratio of the given one of the display pixels based on the current deterioration functions $F_i(t)$ and the history of a video signal of the given one of the display pixels by:

calculating respective current deterioration ratio increments for time periods in the history of the video signal of the given one of the display pixels, each current deterioration ratio increment being calculated from one of the current deterioration functions $F_i(t)$ that corresponds to the video signal level applied to the given one of the display pixels in the respective time period; and adding the calculated current deterioration ratio increments together to obtain the predicted current deterioration ratio.

10. The display device according to claim 5, wherein the control circuit is further configured to:

select one of the second dummy pixels $D'_j$ to be a reference second dummy pixel $D'_s$;

derive from the detected amount of light $Y_s$ corresponding to the reference second dummy pixel $D'_s$ a reference efficiency deterioration function $F'_s(t)$ having time as an independent variable;

derive respective power coefficients $n'(Y_j, Y_s)$ from the detected amounts of light $Y_j$;

derive from the power coefficients $n'(Y_j, Y_s)$ and the reference efficiency deterioration function $F'_s(t)$ respective efficiency deterioration functions $F'_j(t)$ having time as an independent variable;

predict an efficiency deterioration ratio of a given one of the display pixels based on the efficiency deterioration functions $F'_j(t)$ and a history of a video signal of the given one of the display pixels, and derive a second correction amount for correcting a video signal to be input to the given one of the display pixels, the second correction amount being derived from the predicted efficiency deterioration ratio for the given one of the display pixels and a gamma characteristic of the display panel.

11. The display device according to claim 10, wherein the control circuit is further configured to predict the efficiency deterioration ratio of the given one of the display pixels based on the efficiency deterioration functions $F'_j(t)$ and the history of a video signal of the given one of the display pixels by:

calculating respective efficiency deterioration ratio increments for time periods in the history of the video signal of the given one of the display pixels, each efficiency deterioration ratio increment being calculated from one of the efficiency deterioration functions $F'_j(t)$ that corresponds to the video signal level applied to the given one of the display pixels in the respective time period;

adding the calculated efficiency deterioration ratio increments together to obtain the predicted efficiency deterioration ratio.

12. A method of driving a display panel comprising:

causing N first dummy pixels $D_i$ to emit light by applying respective signal voltages $V_i$ having magnitudes different from each other to the first dummy pixels $D_i$, where N is an arbitrary integer >2, and i is an index such that $i=\{1, 2, \ldots, N\}$;

detecting respective currents $S_i$ that flow through the first dummy pixels $D_i$ as a result of the application of the respective signal voltages $V_i$;

deriving from the detected currents $S_i$ a current deterioration function that estimates current deterioration;

causing M second dummy pixels $D'_j$ to emit light by flowing respective constant currents $I_j$ having magnitudes different from each other through the second dummy pixels $D_j$, where M is an arbitrary integers $\geqq 2$, and j is an index such that $j=\{1, 2, \ldots, \}$;

detecting respective amounts of light $Y_j$ that are emitted from the second dummy pixels $D'_j$ as a result of the flowing of the respective constant currents $I_j$; and deriving from the amounts of light $Y_j$ an efficiency deterioration function that estimates efficiency deterioration.

13. The method according to claim 12, further comprising:

predicting a current deterioration ratio of a display pixel based on the current deterioration function and a history of a video signal of the display pixel, and deriving a first correction amount for correcting a video signal to be input to the display pixel, the first correction amount being derived from the predicted current deterioration ratio for the display pixel and a gamma characteristic of the display panel.

14. The display device according to claim 12, further comprising:

predicting an efficiency deterioration ratio of a display pixel based on the efficiency deterioration function and a history of a video signal of the display pixel, and deriving a second correction amount for correcting a video signal to be input to the display pixel, the second correction amount being derived from the predicted efficiency deterioration ratio for the display pixel and a gamma characteristic of the display panel.

* * * * *